US007395025B2

(12) United States Patent
Matsuzuki et al.

(10) Patent No.: US 7,395,025 B2
(45) Date of Patent: Jul. 1, 2008

(54) FEEDING DEVICE AND FEEDING METHOD, AND IMAGE FORMING DEVICE

(75) Inventors: Masato Matsuzuki, Kawasaki (JP); Shigeo Ishida, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/483,065

(22) PCT Filed: Jul. 23, 2001

(86) PCT No.: PCT/JP01/06358

§ 371 (c)(1),
(2), (4) Date: Jan. 7, 2004

(87) PCT Pub. No.: WO03/010080

PCT Pub. Date: Feb. 6, 2003

(65) Prior Publication Data

US 2004/0175213 A1 Sep. 9, 2004

(51) Int. Cl.
*G03G 15/00* (2006.01)
*B41J 15/04* (2006.01)
*B41J 15/16* (2006.01)
*B65H 23/00* (2006.01)

(52) U.S. Cl. ..... 399/384; 399/388; 399/395; 400/578; 400/579; 400/611; 400/613

(58) Field of Classification Search ..... 399/384
See application file for complete search history.

(56) References Cited

U.S. PATENT DOCUMENTS 3,653,757 A * 4/1972 Newcomb ..... 399/387
3,800,992 A * 4/1974 Yamagishi ..... 226/11
4,496,955 A * 1/1985 Maeyama et al. ..... 347/178
4,819,024 A * 4/1989 Kagayama et al. ..... 399/385
4,838,719 A * 6/1989 Une ..... 400/618
4,919,318 A 4/1990 Wong
4,961,089 A * 10/1990 Jamzadeh ..... 399/165
5,008,710 A * 4/1991 Kobayashi et al. ..... 399/317
5,172,989 A * 12/1992 Imaseki et al. ..... 400/641
5,259,307 A * 11/1993 Bourgeois et al. ..... 101/118
5,337,944 A * 8/1994 Shiba ..... 226/108

(Continued)

FOREIGN PATENT DOCUMENTS

JP A 58-89387 5/1983

(Continued)

*Primary Examiner*—Daniel J. Colilla
*Assistant Examiner*—Wynn' Q Ha
(74) *Attorney, Agent, or Firm*—Oliff & Berridge PLC

(57) ABSTRACT

A paper transporting apparatus transporting continuous paper to a paper processing part that performs designated processing on the continuous paper includes a drive roller that transports the continuous paper in a forward direction with respect to the paper processing part and a direction opposite to the forward direction by a frictional force, a pre-centering mechanism, disposed upstream of the drive roller with respect to the forward direction, that regulates a position of the continuous paper with respect to the forward direction and a direction orthogonal to the forward direction by abutting against the continuous paper, and a tension increasing mechanism, disposed upstream of the pre-centering mechanism with respect to the forward direction, that increases tension on the continuous paper.

10 Claims, 20 Drawing Sheets

U.S. PATENT DOCUMENTS

| | | | | |
|---|---|---|---|---|
| 5,499,093 | A * | 3/1996 | Aerens et al. | 399/228 |
| 5,685,471 | A | 11/1997 | Taubenberger | |
| 5,774,777 | A * | 6/1998 | Ohtsuka et al. | 399/384 |
| 5,970,304 | A * | 10/1999 | Stemmle | 399/364 |
| 6,104,907 | A * | 8/2000 | Obata et al. | 399/384 |
| 6,357,349 | B1 * | 3/2002 | Tomberlin et al. | 101/219 |
| 6,412,992 | B2 * | 7/2002 | Mogi | 400/579 |
| 6,650,864 | B2 * | 11/2003 | Miyamoto et al. | 399/384 |
| 6,659,006 | B2 * | 12/2003 | Brennan et al. | 101/225 |
| 6,668,716 | B2 * | 12/2003 | Tsuruta et al. | 101/33 |
| 6,673,220 | B2 * | 1/2004 | Voutsas et al. | 204/298.13 |
| 6,763,220 | B2 * | 7/2004 | Nakazawa | 399/401 |
| 6,799,507 | B2 * | 10/2004 | Ohba et al. | 101/228 |
| 6,922,205 | B2 * | 7/2005 | Mogi | 347/171 |
| 6,969,206 | B2 * | 11/2005 | Iwanaga et al. | 400/618 |
| 2003/0039496 | A1 * | 2/2003 | Miyamoto et al. | 399/384 |
| 2003/0185608 | A1 * | 10/2003 | Miyamoto et al. | 399/384 |
| 2004/0175213 | A1 * | 9/2004 | Matsuzuki et al. | 399/384 |

FOREIGN PATENT DOCUMENTS

| | | |
|---|---|---|
| JP | A 2-152840 | 6/1990 |
| JP | A 11-189355 | 7/1999 |
| JP | A 11-349191 | 12/1999 |
| JP | A 2000-178639 | 6/2000 |

* cited by examiner

FEEDING DEVICE AND FEEDING METHOD, AND IMAGE FORMING DEVICE

BACKGROUND OF THE INVENTION

1. Field of the Invention

The present invention relates to a transporting apparatus and method. The present invention is suitable for a transport mechanism of a pinless printer transporting continuous paper having no feed pins (or tractor pins). The continuous paper here falls into two categories: paper folded back at perforations formed per given length, and a continuous roll of paper.

2. Description of Related Art

Conventional continuous paper is formed with sprocket holes serving as through holes at side edges provided separably from a main body used as a printable area. The continuous paper is transported while feed pins of a paper transport system of a printer are engaging in the sprocket holes. Although such continuous paper has the advantage of being transported in a transport direction without being skewed or becoming slack, it takes processing costs to form through holes at both side edges. Furthermore, since the both side edges are unusable for printing, they must be separated at the termination of printing, leaving dust behind. For this reason, there are demands for the use of continuous paper having no holes at the both side edges. In this case, however, technologies are required for transporting the continuous paper in the transport direction without being skewed or becoming slack.

In a transport mechanism disclosed by Japanese Translation of Unexamined PCT Appln. No. 507666/1997, a paper position regulation unit is provided that presses one edge of holeless continuous paper against a stopper to regulate the position of the continuous paper with respect to a direction orthogonal to a transport direction, and a tension increasing unit and an accumulator are disposed at the following stage of the paper position regulation unit with respect to the transport direction (forward direction). The tension increasing unit, which is made up of a vacuum brake, increases tension on the paper to prevent swing or paper skew in the direction orthogonal to the transport direction of the paper. The accumulator, which is made up of a roller moving vertically, increases tension on the paper to remove slack in the paper in a back feed operation for transporting the paper in a direction opposite to the transport direction (forward direction) during printing. The paper is transported in the forward direction and the backward direction by a drive roller provided at the following stage of the accumulator with respect to the transport direction.

Since printers have been sped up, paper overruns several inches when it stops, and the paper must be run preparatorily several inches when printing is started. Accordingly, when printing is stopped and restarted, a back feed is performed to pull back the paper in the backward direction by the sum of the distances of the overrun and the preparatory run, thereby preventing an excessive space between an image printed previously and the next image to be printed. To stabilize the run of the high-speed printers during paper activation, a back feed amount must be increased to drop activation acceleration. This is because a high activation acceleration leaves inertia in a motor for driving a following drive roller and disables quick transition to a constant speed.

The above-described patent application has several problems. Specifically, (1) the separate arrangement of the tension increasing unit and the accumulator increases the size and cost of the transport mechanism. (2) Since the accumulator removes slack in the paper by vertical movement of the roller, large slack in the paper would increase the distance of vertical movement of the accumulator. Accordingly, if a back feed amount is increased to cope with the speedup of printers, a space for the vertical movement of the accumulator must be allocated in the apparatus, increasing the size of the apparatus. (3) Since vertical movement of the accumulator causes vertical changes in the transport direction, the paper is easily skewed and runs unstably. (4) The vacuum brake is susceptible to wear. Since the vacuum brake applies brake force in accordance with the width of the paper, a different brake force is applied for a different paper width. Therefore, for different paper types, the vacuum brake cannot always apply desired brake forces. (5) Since the tension increasing unit is disposed at the following stage of the paper position regulation unit with respect to the transport direction, paper slack occurring between the paper position regulation unit and the tension increasing unit cannot be removed. (6) Since the tension increasing unit must press a paper edge against the stopper so as not to crush (buckle) it, it is difficult to adjust press forces. Paper buckling limitations limit the types of usable paper. In other words, such a tension increasing mechanism is unsuitable for treating thin paper.

SUMMARY OF THE INVENTION

Accordingly, the present invention provides a paper transporting apparatus and method that can achieve paper run stability during transport and the miniaturization and cost reduction of the apparatus with a relatively simple construction, and an image forming apparatus having the paper transporting apparatus.

According to an aspect of the present invention, the paper transporting apparatus transports continuous paper to a paper processing part that performs designated processing on the continuous paper, wherein the paper transporting apparatus includes a drive roller that transports the continuous paper in a forward direction with respect to the paper processing part and a direction opposite to the forward direction by a frictional force, a pre-centering mechanism, disposed upstream of the drive roller with respect to the forward direction, that regulates a position of the continuous paper with respect to the forward direction and a direction orthogonal to the forward direction by abutting against the continuous paper, and a tension increasing mechanism, disposed upstream of the pre-centering mechanism with respect to the forward direction, that increases tension on the continuous paper. Since the paper transporting apparatus has the tension increasing mechanism provided upstream of the pre-centering mechanism, slack in the continuous paper between the tension increasing mechanism and the drive roller can be removed.

Alternatively, the tension increasing mechanism may increase tension on the continuous paper when the drive roller transports the continuous paper in the forward direction and the backward direction. Since the tension increasing mechanism has both the function for increasing tension when the continuous paper is transported in the forward direction, and the function for increasing tension when the continuous paper is transported in the backward direction, more contribution can be made to the miniaturization and cost reduction of the apparatus than when a different tension increasing mechanism is provided for each of the both transport directions.

The tension increasing mechanism may include a roller that rotates in the forward direction at a circumferential speed slower than a transport speed of the drive roller when the drive roller transports the continuous paper in the forward direction, and that rotates in the backward direction at a circumferential speed faster than the transport speed of the drive roller when the drive roller transports the continuous paper in the backward direction. Tension can be increased by speeding up the downstream roller in a direction in which the paper is transported.

The pre-centering mechanism may include a guide part that abuts against an edge of the continuous paper to regulate its position, and a skew roller, provided on the skew by a designated angle with respect to the guide part, that energizes the continuous paper so as to press the continuous paper against the guide part when the continuous paper is transported in the forward direction and the backward direction, the designated angle being set variable. Since the designated angle is variable, the pre-centering mechanism can center the continuous paper in any of the transport direction of the continuous paper, the forward direction, and the backward direction.

According to another aspect of the present invention, the paper transporting apparatus transports continuous paper to a paper processing part that performs designated processing on the continuous paper, wherein the paper transporting apparatus includes a drive roller that transports the continuous paper to the paper processing part by a frictional force, and a skew roller, disposed upstream of the drive roller with respect to a transport direction toward the paper processing part from the drive roller, and on the skew by a variable angle with respect to the transport direction, that energizes the continuous paper while changing the angle so as to converge swing of the continuous paper with respect to a direction orthogonal to the transport direction to zero, wherein a distance between the drive roller and the designated position is greater than a distance between the paper processing part and the drive roller. The paper transporting apparatus regulates the swing of the continuous paper with respect to a direction orthogonal to the transport direction by a frictional force by the skew roller without pressing the continuous paper against a stopper and the like. Therefore, the buckling (crush) of the continuous paper can be prevented. Since a designated angle of the skew roller is variable, the continuous paper can be precisely positioned to reduce the fluctuation of the continuous paper in the paper processing part. Position regulation control can be achieved by a detection part that detects the position of the continuous paper with respect to the orthogonal direction, and a control part that controls change of the designated angle based on a detection result of the detection part.

An image forming apparatus having the above-described paper transport apparatus also constitutes another aspect of the present invention. This image forming apparatus also has the function of the above-described paper transporting apparatus.

A paper transport method as another aspect of the present invention includes the steps of: driving a drive roller that nips continuous paper together with plural driven rollers and transports the continuous paper to a paper processing part performing designated processing on the continuous paper by a frictional force in a forward direction and a direction opposite to the forward direction; increasing tension on the continuous paper when the continuous paper is transported via a tension increasing mechanism provided upstream of a pre-centering mechanism with respect to the forward direction, wherein the pre-centering mechanism is disposed upstream of the drive roller with respect to the forward direction and regulates the position of the continuous paper with respect to the forward direction and a direction orthogonal to the forward direction by abutting against the continuous paper; and controlling the driving step and/or the increasing step so that a relation of $W>U>W/N$ holds, where W is a transport force by the drive roller, N is the number of the driven rollers, and U is a paper load force by the tension increasing mechanism. This method also has the same function as the above-described apparatus. Particularly, the above-described relational expression makes it possible to remove minor slack generated in the continuous paper due to disturbance in cooperation between the drive roller and the tension increasing mechanism.

When a distance between a portion of the pre-centering mechanism abutting against the continuous paper and the drive roller is A, and a width of the continuous paper is L, the control step may control the driving step or the increasing step so that A/L is 1.0 or more. This method also has the same function as the above-described apparatus. Particularly, the above-described relational expression makes it possible to promote automatic correction on slack by the drive roller. As described above, tension can be increased by speeding up a roller downstream with respect to the direction in which the paper is transported.

A transport method as another aspect of the present invention includes the steps of: driving a drive roller that nips continuous paper together with plural driven rollers and transports the continuous paper to a paper processing part performing designated processing on the continuous paper by a frictional force; driving a skew roller, disposed upstream of the drive roller with respect to a transport direction toward the paper processing part from the drive roller, and on the skew by a variable angle with respect to the transport direction, that energizes the continuous paper to regulate the position of the continuous paper with respect to a direction orthogonal to the transport direction; detecting the position of the continuous paper with respect to the orthogonal direction; and controlling change of the angle so as to converge swing of the continuous paper with respect to the orthogonal direction to zero based on a result of the detecting step. This transport method also has the same function as the above-described paper transporting apparatus.

Other characteristics of the present invention will be made apparent by embodiments described with reference to the accompanying drawings.

BRIEF DESCRIPTION OF THE DRAWINGS

Preferred embodiments of the present invention will be described in detail based on the followings, wherein.

DESCRIPTION OF THE PREFERRED EMBODIMENTS

Figure 1:
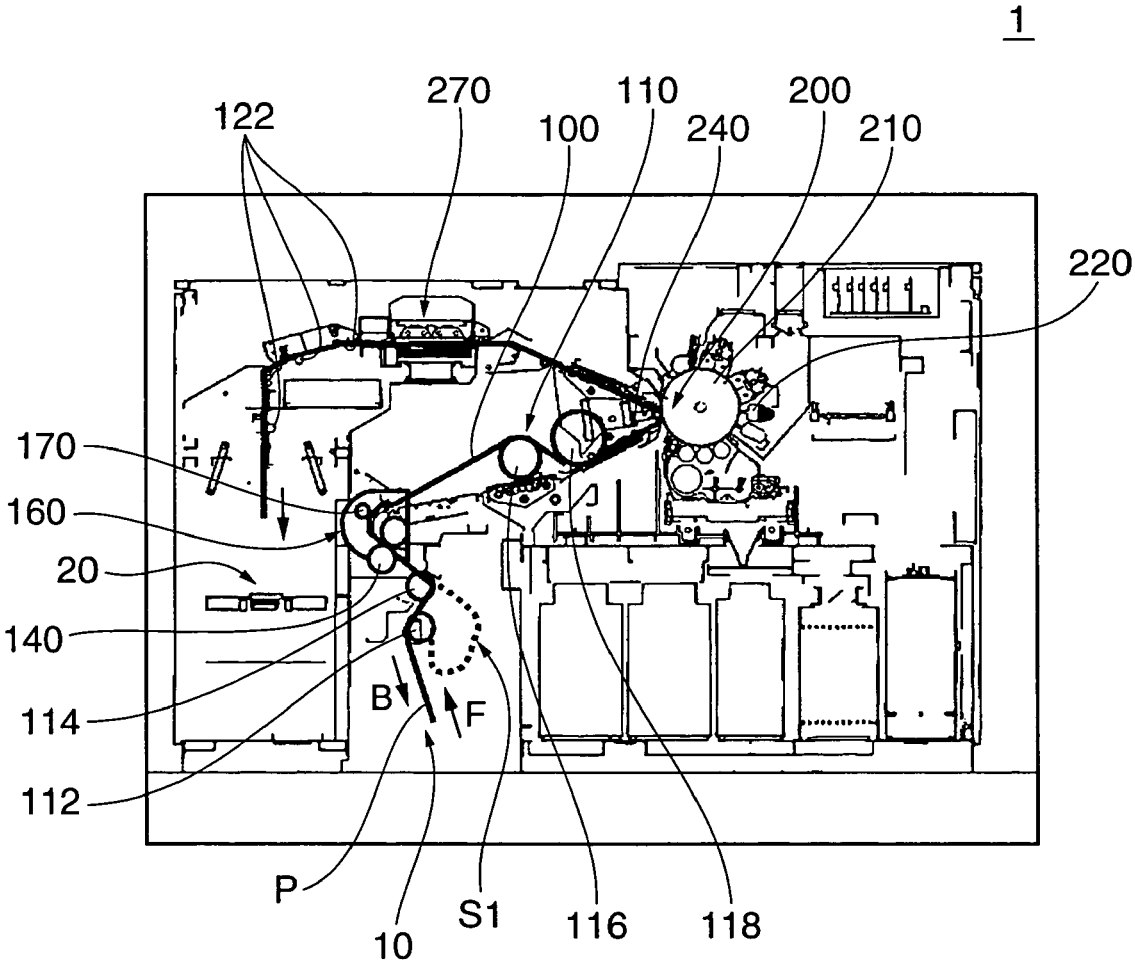
FIG. 1 is a sectional view of a printer of a first embodiment of the present invention.

Hereinafter, a printer 1 of a first embodiment of the present invention will be described with reference to the accompanying drawings. As shown in FIG. 1, the printer 1 includes: a hopper 10 that stores continuous paper P; a stacker 20 that stores continuous paper P on which designated images are formed; a transporting mechanism 100; an image forming part 200; and a control system 300 (not shown in FIG. 1). FIG. 1 is a sectional view of the printer 1.

The continuous paper p, which has no holes for tractor pins, excels perforated continuous paper in processing and environment aspects, and is inexpensive. It does not matter whether the continuous paper P is paper folded along perforations formed every a given length or a continuous roll of paper. The hopper 10 and the stacker 20 are not described in detail here because they can employ any constructions known to the industry regardless of their names.

The transporting mechanism 100 transports the continuous paper P from the hopper 10 to the stacker 20 and removes and prevents the slack and a horizontal deviation of the continuous paper P so as to form high-quality images on it. The continuous paper P is fed from the hopper 10 to the stacker 20 automatically or manually by the user during initialization of the printer.

The transporting mechanism 100 includes a transporting system 110, a back tension roller part 140, and a pre-centering mechanism 160.

Figure 2:
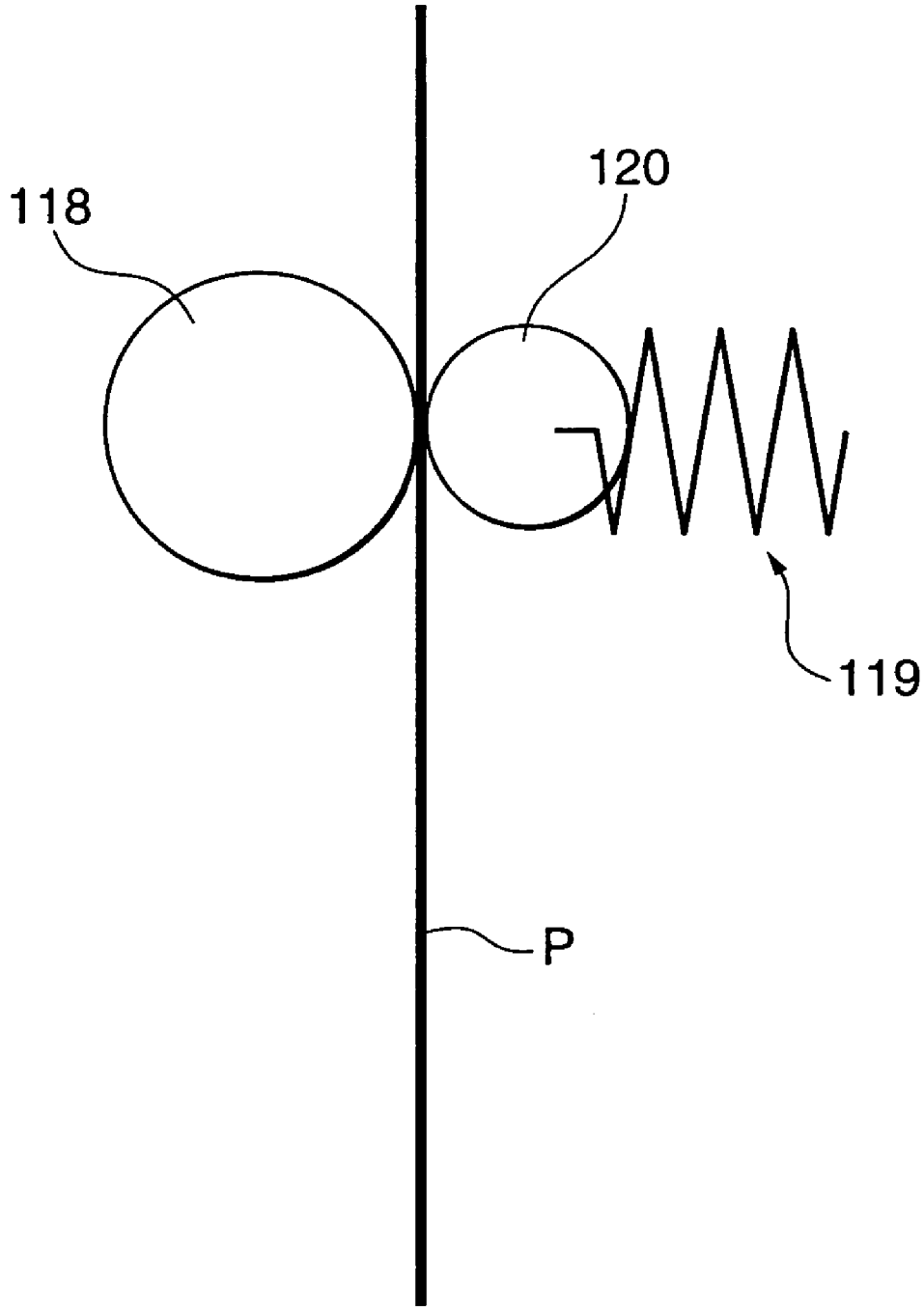
FIG. 2 is a schematic sectional view showing the neighborhood of a drive roller of the printer shown in FIG. 1.
Figure 3:
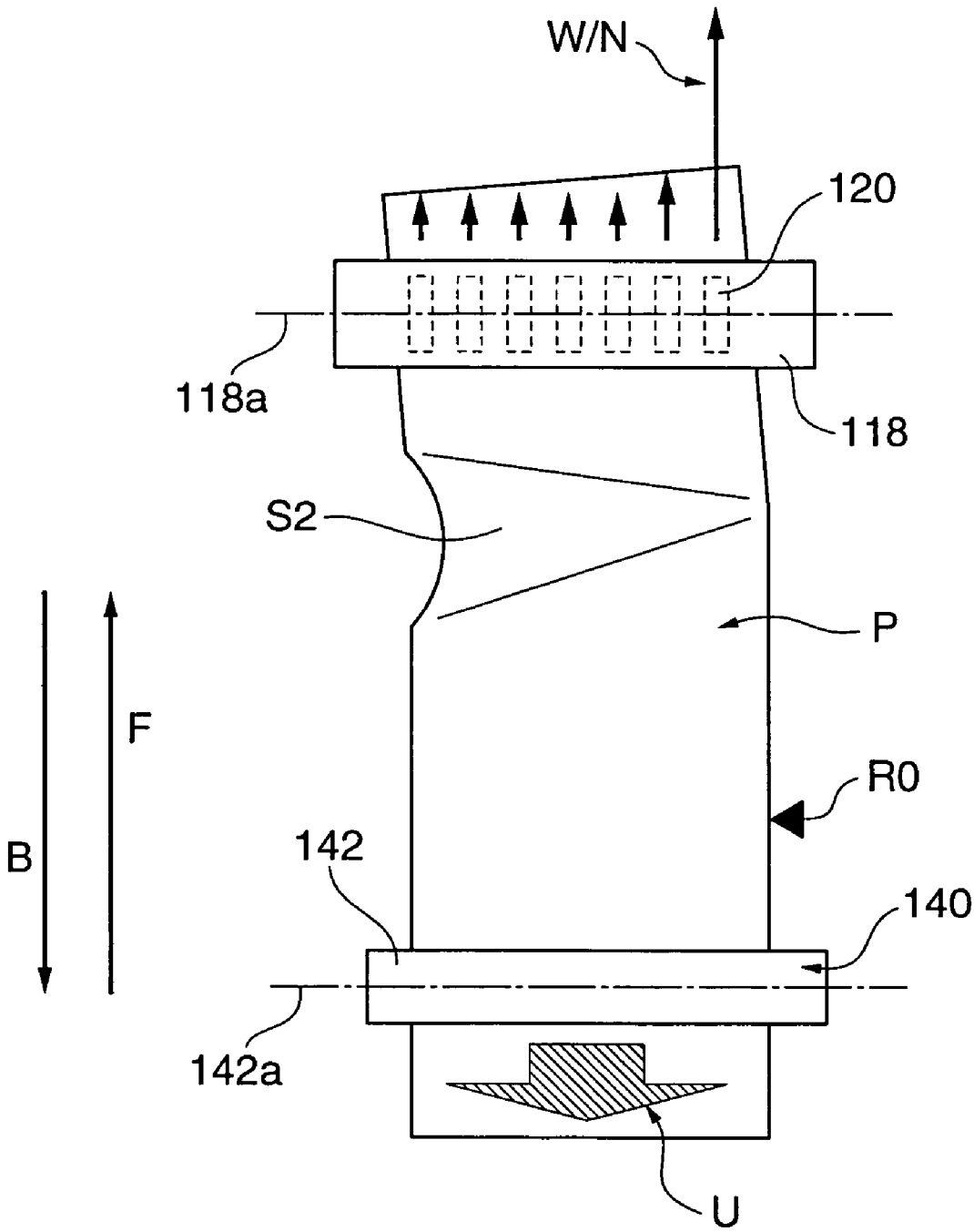
FIG. 3 is a schematic plan view showing a portion from a back tension roller to a drive roller for explaining the removal of slack in continuous paper by the printer shown in FIG. 1.
Figure 9:
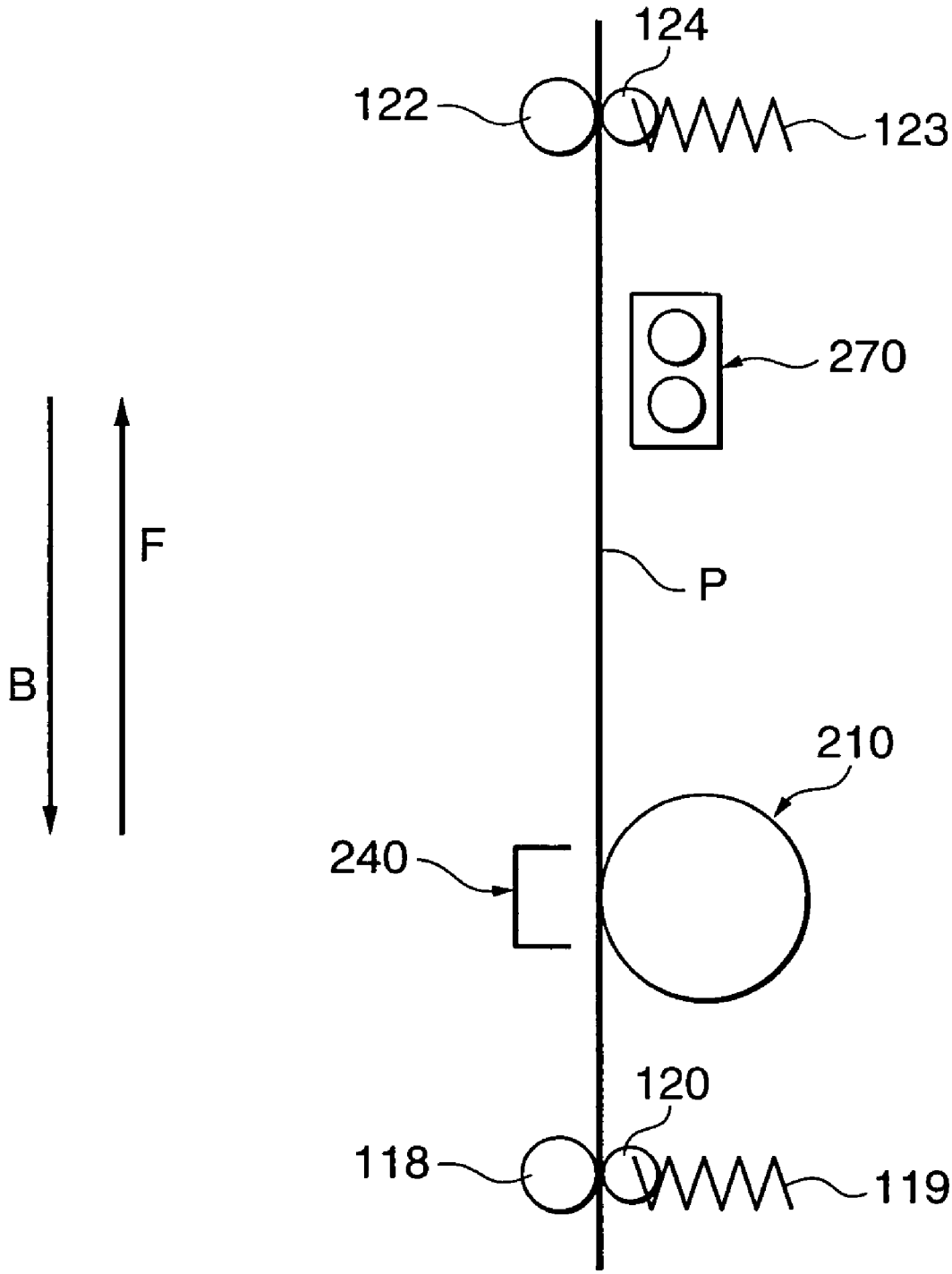
FIG. 9 is a schematic sectional view for explaining the disposition of an image forming part, a driver roller, and a stuff roller of the printer shown in FIG. 1.

The transporting system 110 transports the continuous paper P. The continuous paper P is transported in a direction F shown in FIG. 1 during printing, and a direction B opposite to the direction F during back feed described later. The present patent application refers to the direction F as a forward direction and the direction B as a backward direction. The transporting system 110 includes round bar guides 112 and 114, a wraparound roller 116, a drive roller 118, a spring 119, plural pinch rollers 120, plural scuff rollers 122, a spring 123, and a scuff driven roller 124. The pinch rollers 120, though omitted in FIG. 1, are shown in FIGS. 2 and 3. The spring 123 and the scuff driven roller 124 are schematically shown in FIG. 9 described later.

The round bar guides 112 and 114, provided between the hopper 10 and the back tension roller part 140 (and the pre-centering mechanism 160), guide the continuous paper P fed from the hopper 10 to the back tension roller part 140 (and the pre-centering mechanism 160) while bending it in its transport direction. The round bar guides 112 and 114 are plastic or metallic rods that are of identical cylindrical shape and dimensions, and their longitudinal direction is orthogonal to the transport direction of the continuous paper P. The number of round bar guides is not limited to two.

The wraparound roller 116 changes the transport direction F of the continuous paper P to guide the continuous paper P at a designated wraparound angle between the drive roller 118 and the pinch roller 120. The wraparound roller 116 has a slip-proof construction such as metallic or plastic shafts covered with resin so as to produce a desired frictional force between the wraparound roller 116 and the continuous paper P.

The drive roller 118 and the pinch rollers 120 are provided downstream of the pre-centering mechanism 160 with respect to the transport direction F. The drive roller 118 is a driving roller and the pinch rollers 120 are driven rollers. Although the drive roller 118 is upward in this embodiment, the pinch rollers 120 may be upward. FIG. 2 is a schematic sectional view showing the relationship between the drive roller 118 and the pinch rollers 120. FIG. 3 is a schematic plan diagram showing a portion from the back tension roller part 140 to the drive roller 118.

The drive roller 118 is of cylindrical shape wider than the continuous paper P and its rotation shaft 118*a* is orthogonal to the transport direction. The rotation shaft 118*a* of the drive roller 118 is directly or indirectly connected to the motor shaft of a motor not shown, and power to the motor is controlled by the control system 300 shown in FIG. 10 described later. Seven of the pinch rollers 120 as shown by the dotted line in FIG. 3 are provided in this embodiment, and juxtaposed at equal intervals in a direction orthogonal to the transport direction F. The width of each pinch roller 120 is narrower than that of the drive roller 118 as shown in FIG. 3, and the distance between the two pinch rollers 120 at both ends is almost equal to the width of the continuous paper P.

Each pinch roller 120 is energized against the drive roller 118 via the continuous paper P by one or more press springs 119. The energized force is far greater than the energized force of the back tension roller part 140 described later. Although energized force by the spring 119 is constant in this embodiment, energized force may be made changeable. In this case, spring pressure by the spring 119 may be made changeable according to the thickness of the continuous paper P, for example.

The energized force of the spring 119 causes a frictional force between the drive roller 118 and the continuous paper P. Using the frictional force, the drive roller 118 guides and transports the continuous paper P to the image forming part 200. The drive roller 118 and the pinch rollers 120 have slip-proof constructions such as metallic shafts covered with resin so as to produce a desired frictional force between the continuous paper P and them.

Three of the scuff rollers 122 are provided in this embodiment, and guide the continuous paper P passing through the image forming part 200 to the stacker 20. The number of the scuff rollers 122 is three as an example in this embodiment.

The scuff rollers 122 are driving rollers and transport the continuous paper P by a frictional force between the continuous paper P and them. The relationship among the scuff rollers 122, the press spring 123, and the scuff driven roller 124 is not described in detail here because it is the same as the relationship among the drive roller 118, the spring 119, and the pinch rollers 120. The scuff rollers 122 have the same construction as that of the drive roller 118, except that their diameter is smaller than that of the drive roller 118. Transport force is produced by the nips of the scuff rollers 122 and the scuff driven roller 124. The transport force and transport speed of the scuff rollers 122 will be described later.

The scuff rollers 122 are provided correspondingly to flash fixing units 270 (described later) of the printer 1 of this embodiment. Specifically, if the printer 1 uses fixing units performing fixing processing by pressurization and heating, since heat rollers are used, the scuff rollers 122 may be omitted. A control method of the present invention described later can apply to even printers having no scuff rollers 122.

Figure 4:
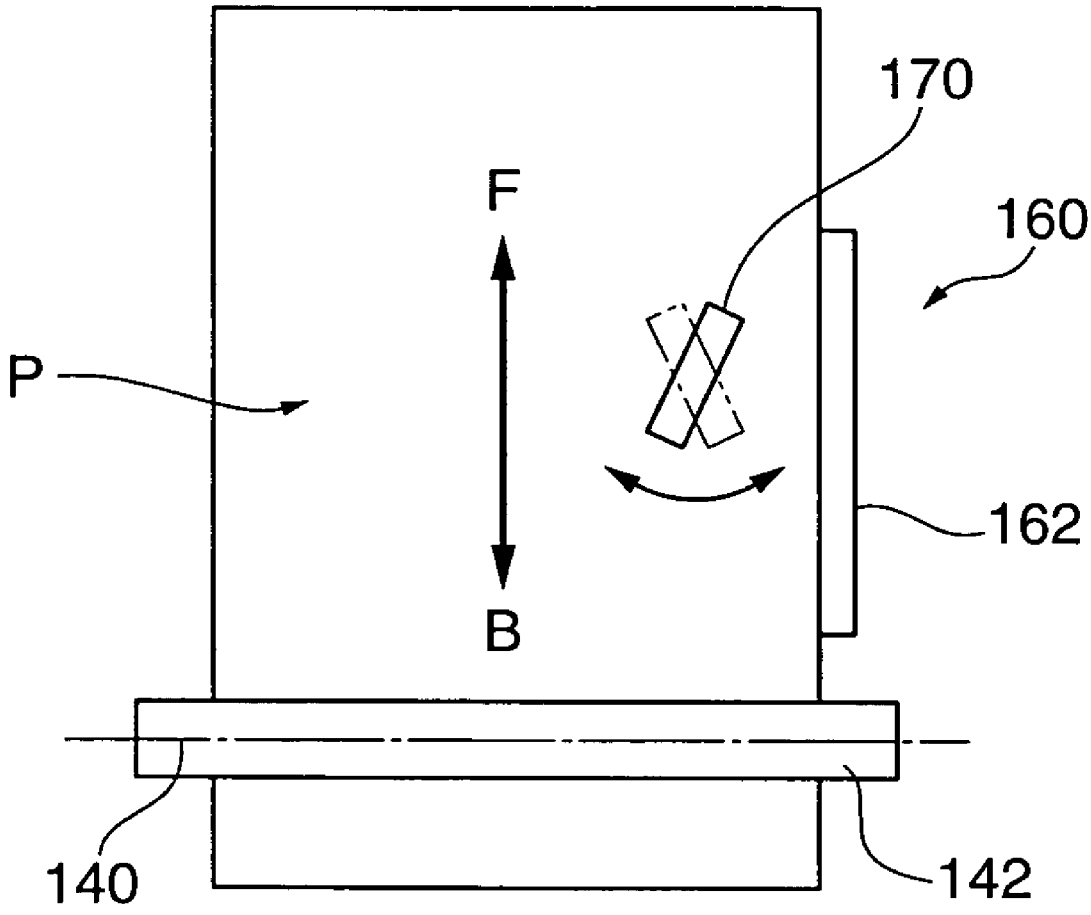
FIG. 4 is a plan view showing the neighborhood of the back tension roller of the printer shown in FIG. 1.
Figure 5:
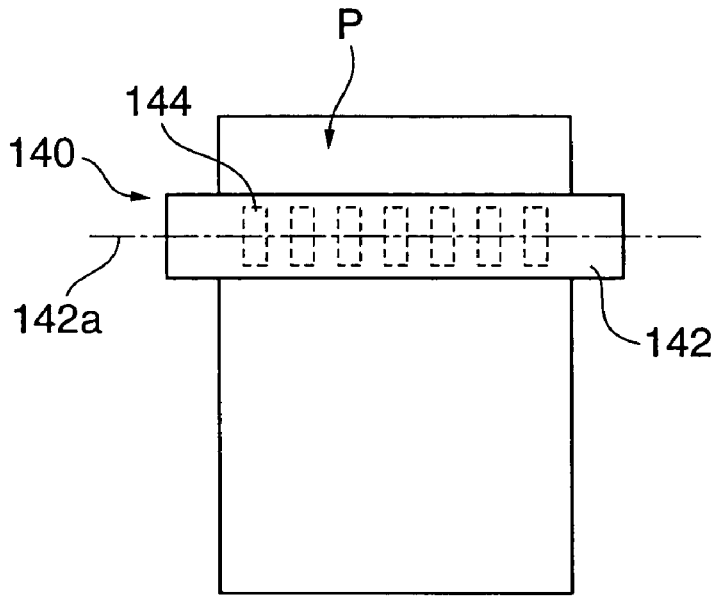
FIG. 5 is an enlarged plan view showing the neighborhood of the back tension roller of the printer shown in FIG. 1.
Figure 6:
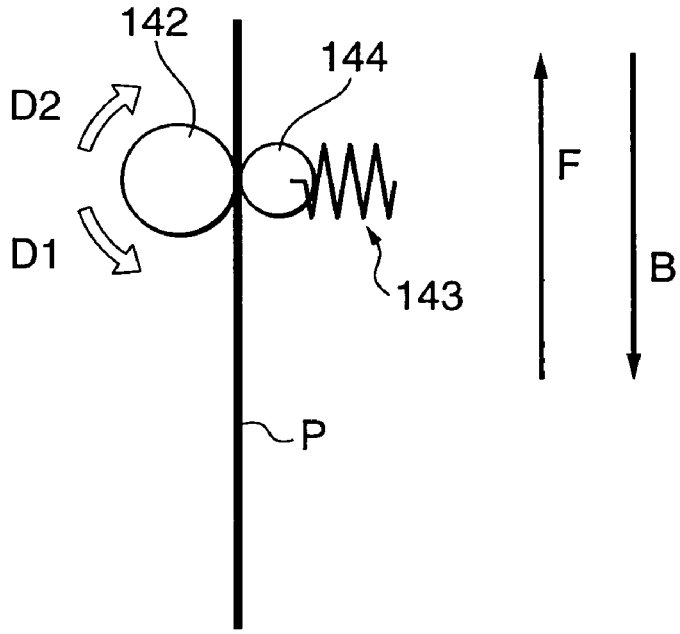
FIG. 6 is a schematic sectional view showing the neighborhood of the back tension roller shown in FIG. 5.

The back tension roller part 140 removes slack in the continuous paper P when it is fed in the forward direction F or the backward direction B. As shown in FIGS. 4 to 6, the back tension roller part 140 includes a driving (upper) roller 142, a spring 143, and a driven (lower) roller 144, the relationship among which is the same as that among the drive roller 118, the spring 119, and the pinch roller 120. FIG. 4 is a plan view of the back tension roller part 140 and the pre-centering mechanism 160. FIG. 5 is an enlarged plan view of the back tension roller part 140. FIG. 6 is a schematic sectional view of the back tension roller part 140. The length and the number of the rollers 142 and 144, and the interval between them can be freely set so long as the continuous paper P can be transported.

As described later, the back tension roller 142 rotates in the forward direction F at a circumferential speed slower than a paper transport speed when the continuous paper P is transported in the forward direction F, and rotates at a circumferential speed faster than the transport speed of the drive roller 118 when the continuous paper P is transported in the backward direction B (that is, the continuous paper P is fed back). Thereby, the back tension roller 142 can increase tension on the continuous paper P all the time during transport in the transport direction F and the backward direction B. In FIG. 6, D1 designates the forward direction in which paper is transported during printing, and D2 designates the backward direction in which paper is fed back.

The rotation shaft 142*a* of the roller 142 is directly or indirectly connected to the motor shaft of a motor described later, and power to the motor is controlled by the control system 300 shown in FIG. 10. As shown in FIGS. 4 and 5, the rotation shaft 142*a* of the roller 142 is orthogonal to the transport direction F. The construction of the roller 142 is the same as that of the drive roller 118, except that its diameter is smaller than that of the drive roller 118.

As shown in FIG. 6, the spring 143 presses the roller 144 against the roller 142 through the continuous paper P. The roller 142 is at a constant distance from the drive roller 118, and does not move vertically as the accumulator described in the above-described patent publication does. The roller 142 can apply a frictional force to the continuous paper P by the press force of the spring 143 and can increase the tension of the continuous paper P by transport force and/or transport speed different from those of the drive roller 118.

The back tension roller part 140 is provided upstream of the pre-centering mechanism 160 with respect to the transport direction. The back tension roller part 140 increases tension on the continuous paper P when the continuous paper P is transported in the forward direction F and the backward direction B. Accordingly, the continuous paper P can be transported without slack between the back tension roller part 140 and the drive roller 118. With conventional constructions, since tension has been applied to continuous paper only between a tension increasing unit and a drive roller, it has been impossible to remove slack occurring in the continuous paper between a paper position regulation part upstream of the tension increasing unit with respect to a transport direction and the tension increasing unit. However, since the back tension roller part 140 of the present embodiment is provided upstream of the pre-centering mechanism 160 with respect to the transport direction F, the continuous paper P can be stably transported without slack.

Since the back tension roller part 140 applies tension to the continuous paper P when the drive roller 118 transports the continuous paper P in the forward direction F and the backward direction B, it has both the functions of conventional accumulators and tension increasing units. Therefore, the transporting apparatus of the present invention can be made more compact in size and lower in cost than the conventional paper transporting apparatus described in the above-described patent publication.

Since the rollers 142 and 144 of the back tension roller part 140 do not move vertically, the transport direction of the continuous paper P is not changed vertically. Accordingly, the back tension roller part 140 excels conventional accumulators in running stability because it causes no skew in the continuous paper P. The back tension roller part 140 also excels conventional tension increasing units including vacuum brakes in that it wears little and can apply constant tension regardless of the width of the continuous paper P.

Figure 7:
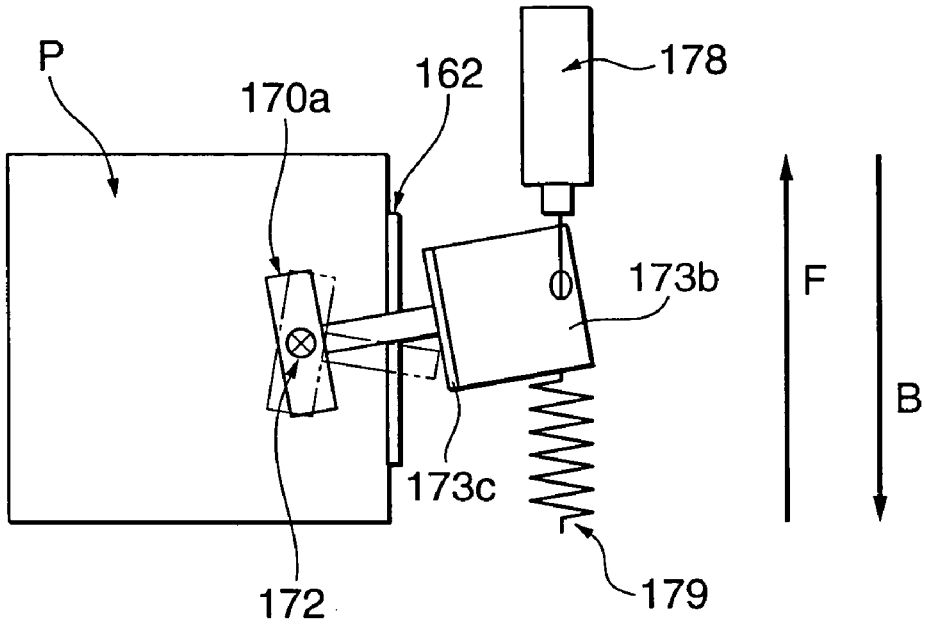
FIG. 7 is a plan view showing a pre-centering mechanism of the printer shown in FIG. 1.
Figure 8:
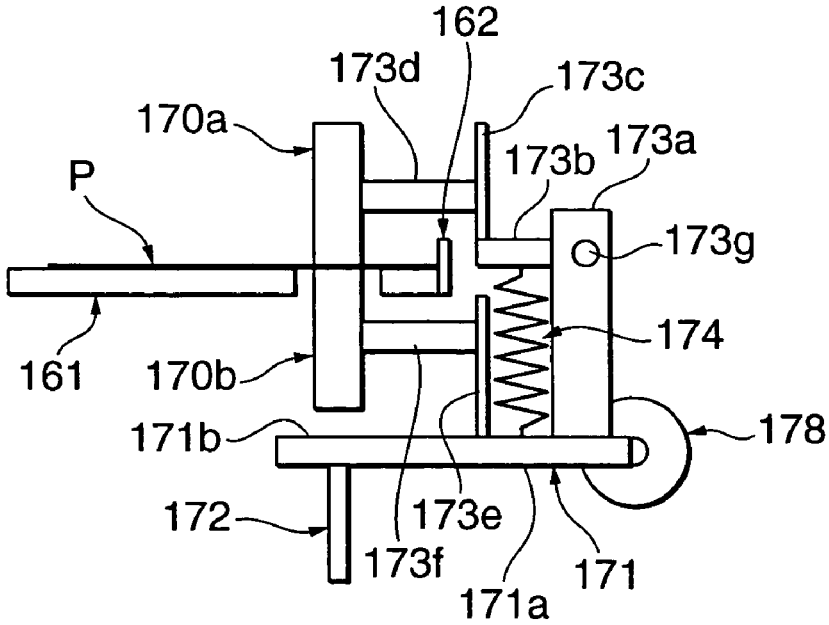
FIG. 8 is a sectional view of the pre-centering mechanism shown in FIG. 7.

The pre-centering mechanism 160 has a function for regulating the position of the continuous paper P in a direction orthogonal to the transport direction thereof to prevent a positional deviation in the transfer position TR (in the area where a photosensitive drum 210 and the continuous paper P contact) of an image forming part 200 described later. The pre-centering mechanism 160 has, as shown in FIGS. 1, 3, 7, and 8, a paper guide 161, an edge guide 162, and a skew roller part 170. FIG. 7 is a plan view of the pre-centering mechanism 160, and FIG. 8 is a sectional view of the pre-centering mechanism 160.

The paper guide 161 is formed as a plate member disposed beneath the paper P in parallel to the transport direction, and guides the continuous paper P. The edge guide 162 is, as shown in FIG. 8, a plate-shaped member vertically secured to an edge of the paper guide 161. The edge guide 162 extends along the transport direction, abuts against an edge of the continuous paper P, and regulates the position of the continuous paper P in a direction orthogonal to the transport direction.

The skew roller part 170 includes a pair of upper and lower rollers 170*a* and 170*b*, a skew roller base 171, a base rotation shaft 172, connecting members 173*a* to 173*f*, a pull spring 174 for pressurizing the upper skew roller 170*a*, a solenoid 178, and a pull spring 179 for restoring the solenoid 178. FIG. 7 shows connecting members 173*b* to 173*d* but omits the skew roller base 171, the connecting member 173*a*, and the like.

Both the skew rollers 170*a* and 170*b* are driven rollers accompanying paper transport. The elastic force of the spring 174 described later causes the upper and lower skew rollers 170*a* and 170*b* to nip the continuous paper P and transport it in a direction orthogonal to a roller shaft not shown. The roller shaft is disposed on the skew by a certain angle with respect to the transport direction (or in the direction in which the edge guide 162 extends). Such an angle is set variable as described later. The skew rollers 170*a* and 170*b* are mounted on the common skew roller base 171.

The base rotation shaft 172 is, as shown in FIG. 8, secured erectly to the plate-shaped base 171, and disposed beneath the center of the skew rollers 170*a* and 170*b*. As a result, the skew roller base 171 can rotate about the rotation shaft 172. The shaft 172 is disposed vertically to the continuous paper P via the point where the skew rollers 170*a* and 170*b* nip the continuous paper P. Such a disposition is made to prevent an excess force from being exerted on the continuous paper P when the skew rollers 170*a* and 170*b* are driven. FIG. 7 is a top-down view of FIG. 8 and conveniently shows the base rotation shaft 172 positioned at the center of the skew rollers 170*a* and 170*b*; actually the base rotation shaft 172 is hidden from view. One end of the base rotation shaft 172 is secured to a lower face 171*a* of the base 171 and the other end is supported to a rotatable member not shown in the figure.

On the base 171, a pair of plate-shaped connecting members 173*a* erect in parallel forward and backward of FIG. 8 and are respectively provided with through holes 173*g*. The plate-shaped connecting members 173*a* face forward and backward of FIG. 8. On the other hand, the plate-shaped connecting members 173*b* are machined flat in the T-character shape, and T-character arms are machined in a cylindrical shape and respectively rotatably inserted in the through holes 173*g*. Alternatively, cylindrical rods are inserted in the through holes 173*g* so that the plate-shaped connecting members 173*b* are secured to the cylindrical rods. In any case, the plate-shaped connecting members 173*b* are rotatably supported to the through holes 173*g* at the right side edge thereof as shown in FIG. 8. The plate-shaped connecting members 173*b* face upward and downward of FIG. 8.

The plate-shaped connecting members 173*b* are connected with the plate-shaped connecting members 173*c* at the left side edge of FIG. 8. As seen from FIG. 7, the plate-shaped connecting members 173*c* face the right side and the left side of FIG. 8. The plate-shaped connecting members 173*c* erect vertically to the plate-shaped connecting members 173*b*, and are connected with one end of the cylindrical connecting members 173*d* at the left side thereof as shown in FIG. 8. The upper skew roller 170*a* is secured to the cylindrical connecting members 173*d*. One end of the pull spring 174 for pressurizing the upper skew roller 170*a* is secured to the lower face of the plate-shaped connecting members 173*b*. The other end of the spring 174 is secured to the upper face 171*b* of the base 171. As a result, the spring 174 presses the skew roller 170*a* against the continuous paper P through the connecting members 173*b* and 173*c*.

On the other hand, a plate-shaped connecting member 173*e* is secured vertically and erectly to the upper face 171*b* of the base 171. The plate-shaped connecting members 173*e* face the right side and the left side of FIG. 8. The plate-shaped connecting member 173*e* is connected with one end of cylindrical connecting members 173*f* at the left side thereof. The lower skew roller 170*b* is secured to the cylindrical connecting members 173*f*. As a result, the continuous paper P is nipped by the skew rollers 170*a* and 170*b*.

The solenoid 178 is connected to the base 171, as briefly shown in FIG. 7. The solenoid 178 connects with a spring 179 for restoring it. The solenoid 178 is turned on and off to change an angle (referred to as a skew angle) for skewing the continuous paper P. A skew angle corresponds to the angle of a roller shaft (not shown) of the above-described skew roller 170*a* with respect to the transport direction. The solenoid 178 rotates the skew rollers 170*a* and 170*b* about the base rotation shaft 172 to change a skew angle.

In this embodiment, skew angles are changed according to the transport direction of the continuous paper P (that is, the forward direction F or the backward direction B). For example, if the continuous paper P is transported in the forward direction F, a skew angle is changed to +2 degrees, and if transported in the backward direction B, a skew angle is changed to −2 degrees. In this embodiment, for example, if the continuous paper P is transported in the forward direction F, a skew angle is kept constant. However, in another different embodiment, a skew angle is changed even for the duration of time that the continuous paper P is being transported in the forward direction F. Thereby, a resilient force exerted on the continuous paper P from the edge guide 162 can be changed, making it possible to prevent the continuous paper P from being buckled.

Upon going on, the solenoid 178 rotates the base 171 about the rotation shaft 172, and when it goes off, the pull spring 179 restores the solenoid 178, so that the base 171 is also restored. Power to the solenoid 178 is controlled by the control system 300 shown in FIG. 10 described later. Alternatively, the other end of the rotation shaft 172 is connected to a motor shaft not shown, or a gear is formed about the rotation shaft 172 and a gear engaged with that gear is connected to the motor shaft not shown. In any case, the rotation about the rotation shaft 172 of the base 171 can be controlled by the control system 300.

The rollers 170*a* and 170*b* are secured to the base 171 through the connecting members 173*a* to 173*f* on the skew at a designated angle with respect to the edge guide 162 (and the transport direction F). A skew angle of the rollers 170*a* and 170*b* can be changed according to the transport direction of the continuous paper P so that the continuous paper P is energized against the edge guide 162 when the continuous paper P is transported in the forward direction F and the backward direction B. Specifically, since the base 171 can rotate about the rotation shaft 172, the rollers 170*a* and 170*b* rotate in response to the rotation of the base 171. As a result, the pre-centering mechanism 160 can, whether the continuous paper P is transported in the forward direction F or the backward direction B, regulate the position of the continuous paper P with respect to a direction orthogonal to the transport direction by pressing it against the edge guide 162.

Although the image forming part 200 forms an image on the continuous paper P by an electrophotographic system, an image forming unit of the present invention is not limited to the electrophotographic system. The image forming part 200 includes the photosensitive drum 210, an optical unit 220, a transfer electrostatic charger 240, and the flash fixing unit 270. These members are briefly shown in FIGS. 1 and 9, and FIG. 11 described later. FIG. 9 is a schematic sectional view for explaining a positional relationship among major components of the image forming part 200, the driver roller 118, and the stuff roller 122. The image forming part 200 includes other components such as an electrostatic charger and a developing unit, which will not be described in detail because any known constructions can apply to the components.

The photosensitive drum 210 has a photosensitive dielectric layer on a rotatable drum-shaped conductive supporting member and is used as an image holding member. For example, the photosensitive drum 210 is a drum-shaped aluminum plate on the surface of which a film about 20 μm thick of separated-function organic photosensitive material is coated, and rotates in the direction of the arrow at a circumferential speed of 70 mm/s. The electrostatic charger is a scorotron electrostatic charger, which supplies a fixed amount of electric charges onto the surface of the photosensitive drum 210. Thereby, the surface of the photosensitive drum 210 can be evenly electrified with about −700V.

The optical unit 220 exposes the photosensitive drum 210 according to image data by use of a light source such as an LED head and a semiconductor laser. As a result of the exposure, the electrification potential of the surface of the photosensitive drum 210 rises to about −70V such that a latent image in accordance with the image data of an image to be recorded is formed. The developing unit supplies fine electrified particles (referred to as toner) supplied from a toner cartridge not shown to the photosensitive drum. By the photosensitive drum 210 and the electrified toner, the latent image on the photosensitive drum 210 is developed and visualized. A developer supplied by the developing unit may be a toner of one ingredient or contain two ingredients such as a toner and a carrier.

The transfer electrostatic charger 240 is configured as a corona electrostatic charger that generates an electric field so as to electrostatically attract the toner and uses a transfer current to transfer the toner image attracted onto the photosensitive drum 210 to the continuous paper P. A transfer guide 242 is provided in the vicinity of the transfer electrostatic charger 240. The transfer guide 242 brings the continuous paper P into intimate contact with the photosensitive drum 210 and separates the continuous paper from the photosensitive drum 210. To form high-quality images on the continuous paper P, it is necessary to prevent horizontal deviation of the paper P in a transfer position TR.

The flash fixing unit 270 irradiates the continuous paper P with light without contact (or applies light energy) and permanently fixes the toner to the continuous paper P. Since the toner after the transfer adheres weakly to the paper P, it will peel off easily. Accordingly, the toner is fixed using energy. However, to obtain sufficient fixing capability, it is necessary to liquefy the solid toner. As energy is applied, the solid toner undergoes changes in state such as semi-solution, spread, and penetration before fixing is completed. As described above, as the flash fixing unit 270, a fixing unit using other than light such as heat and pressure may be used. In this case, a heat roller of the fixing unit contacts the continuous paper P and fixes the toner by pressurizing and heating. In such a fixing unit, since the heat roller has the function of the scuff roller 122 as well, the scuff roller 122 may be omitted. As described above, however, the paper transport control method and the paper transporting apparatus of the present invention can also apply to such a printer.

Figure 10:
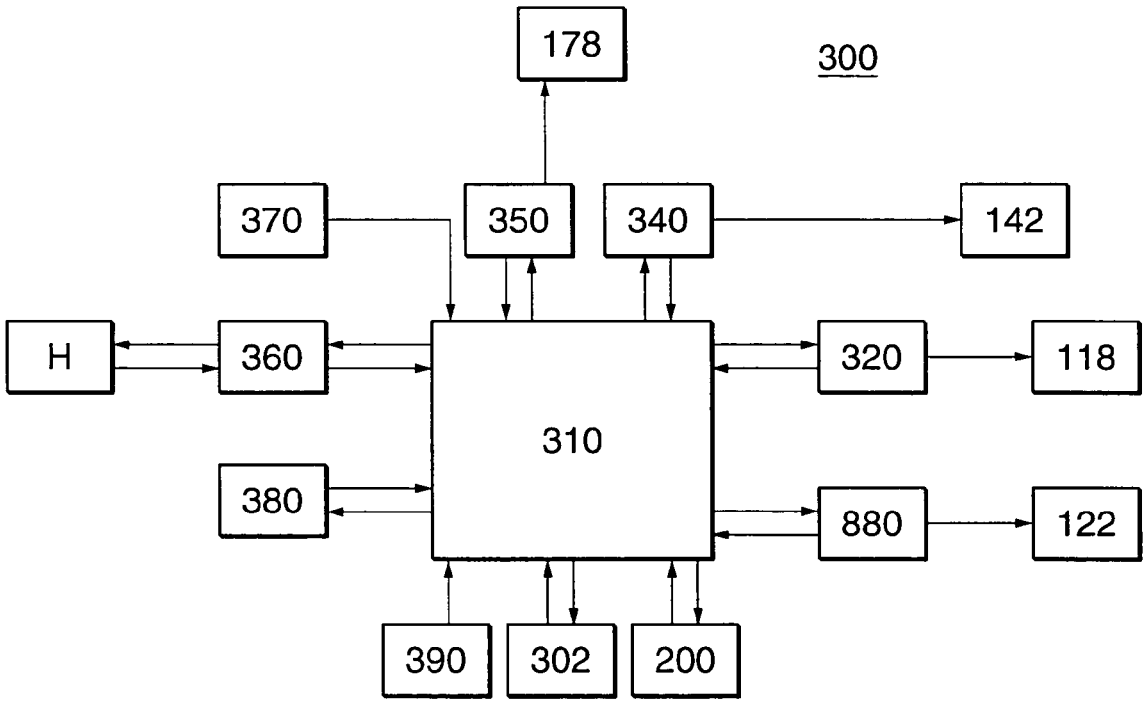
FIG. 10 is a block diagram showing a control system of the printer shown in FIG. 1.

The control system 300 includes, as shown in FIG. 10, a memory 302, a control part 310, a driver 320 for driving a motor (not shown in the figure) connected to a drive roller 118, a driver 330 for driving a motor (not shown in the figure) connected to a scuff roller 122, a driver 340 for driving a motor (not shown in the figure) connected to a back feed roller 142, a driver 350 for driving a solenoid 178, a communication part 360, different types of sensors 370 such as a photosensor, an operation panel 380, and an oscillator 390 for oscillating clocks. FIG. 10 is a schematic block diagram of the control system 300.

The memory 302 stores data necessary for the control method of the present invention and its execution. The memory 302 includes, ROM, RAM, and the like. For example, the memory 302 stores time TX (X-1, 2 . . . ), velocity VD, and the like.

The control part 310 controls a printing operation by the image forming part 200 while establishing synchronization between the printing operation and a transport operation so that required information is recorded in designated positions of the continuous paper P. The control part 310 executes the control method of the present invention described later through communication with the memory 302. The control part 310 communicates with a host device H (e.g., a personal computer (hereinafter simply referred to as "PC")) (through a printer driver stored in the PC) connected to the printer 1 through the communication part 360. The control part 310 communicates with the operation panel 380 and performs required processing according to input operations of the operation panel 380 by the user of the printer 1.

The oscillator 390 generates basic clocks used for different types of timing processing by use of a pulse oscillator, a counter, and other known technologies. The control part 310, in response to commands from the host device H or the operation panel 380, using the sensor 360 if necessary, controls various drivers 320 to 350 based on the oscillator 390 to control the drive roller 118, the scuff roller 122, and back tension roller 142, and the solenoid 178.

Figure 11:
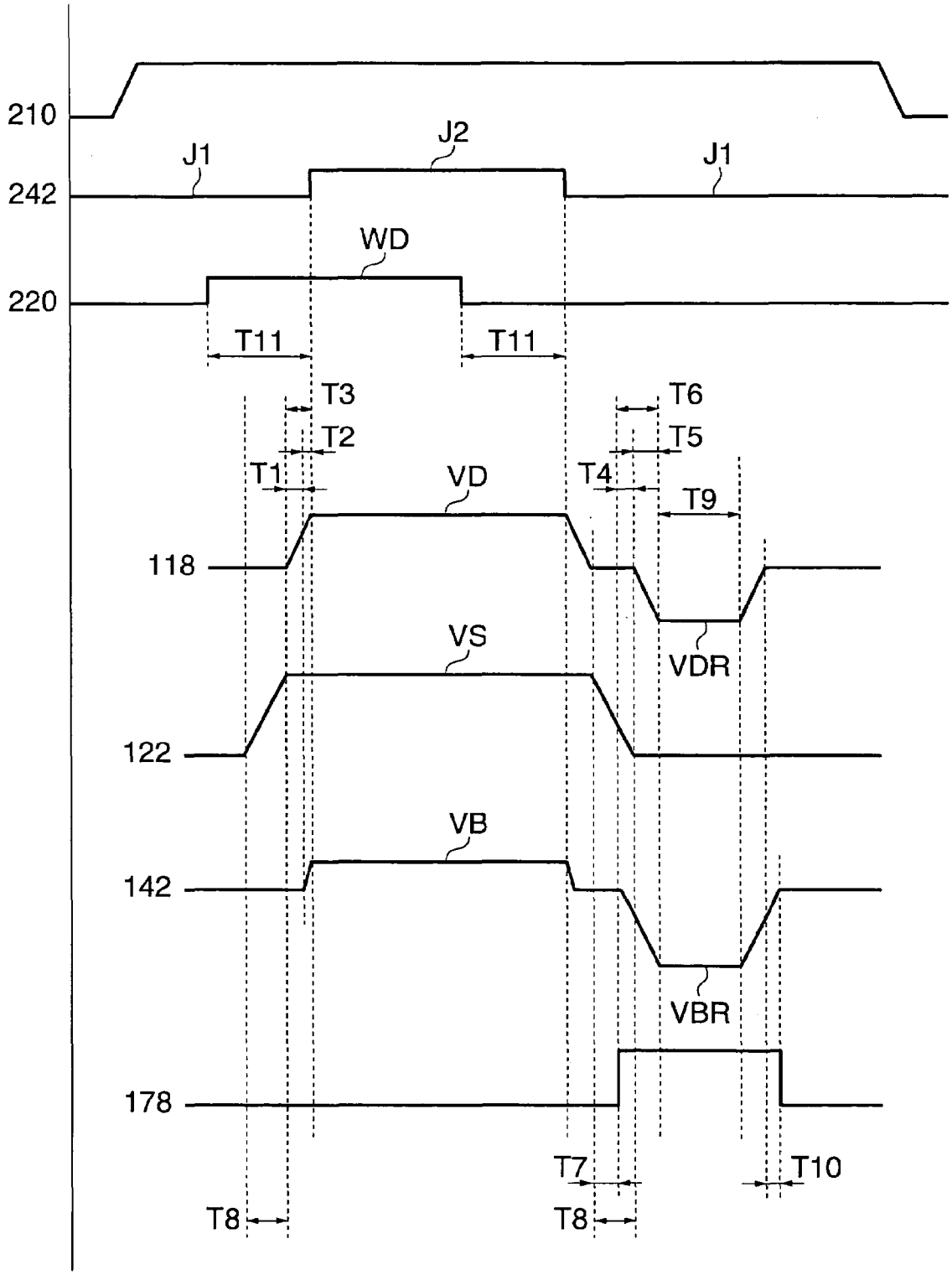
FIG. 11 is a timing chart used for a transport control method performed by the control system shown in FIG. 10.
Figure 12:
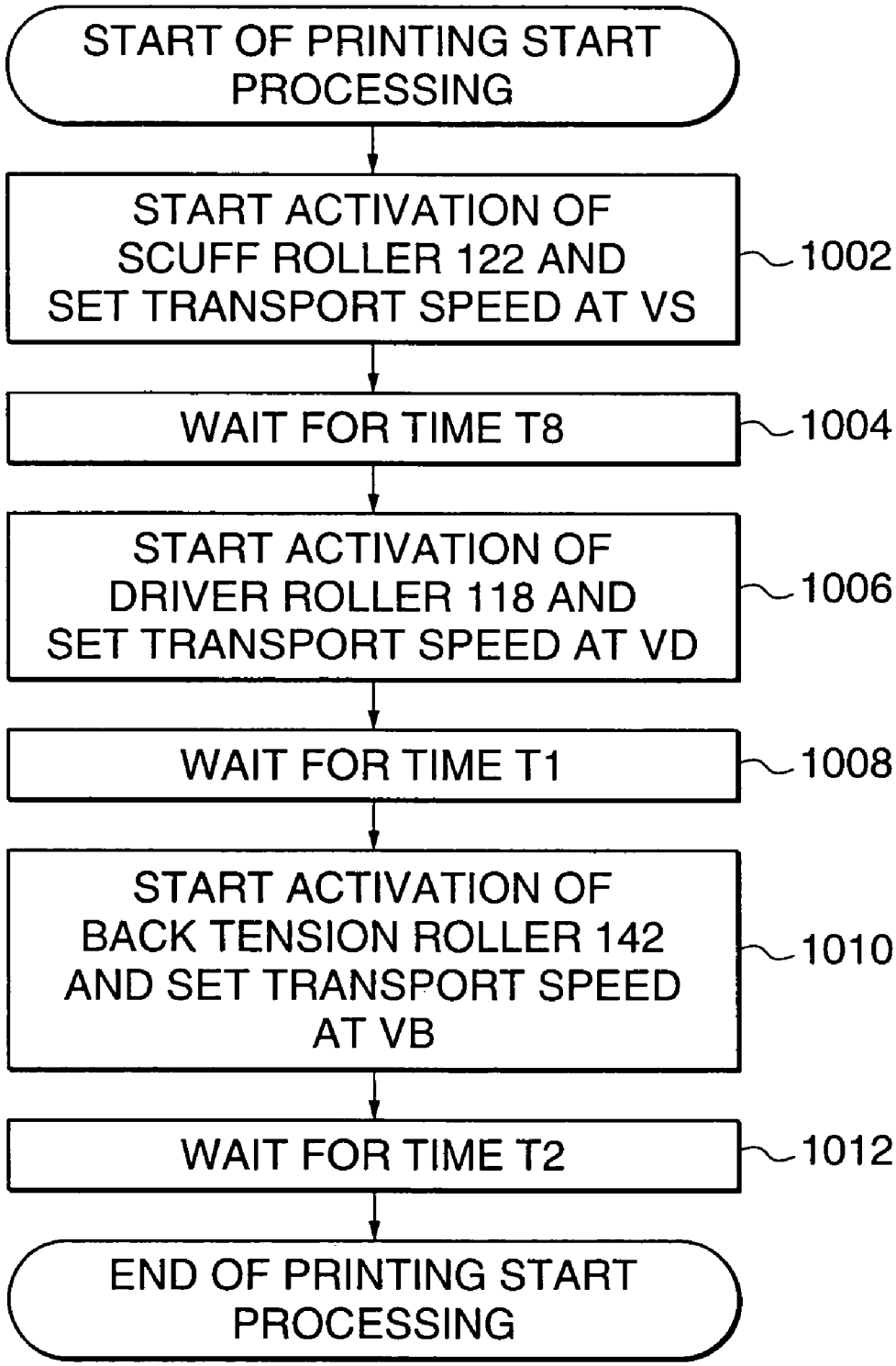
FIG. 12 is a flowchart of printing start processing performed by the control system shown in FIG. 10.
Figure 13A:
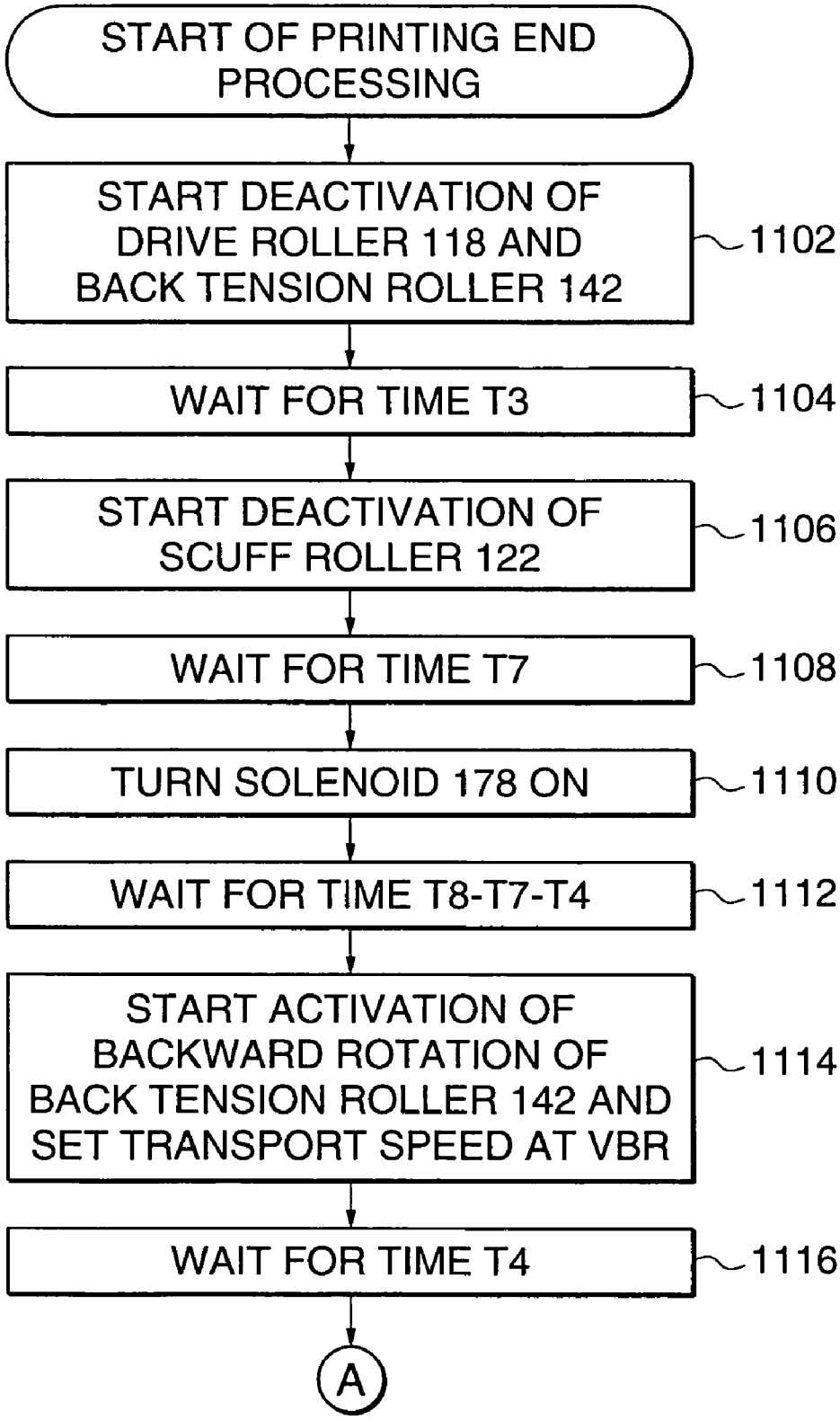
FIG. 13 is a flowchart of printing end processing performed by the control system shown in FIG. 10.
Figure 13B:
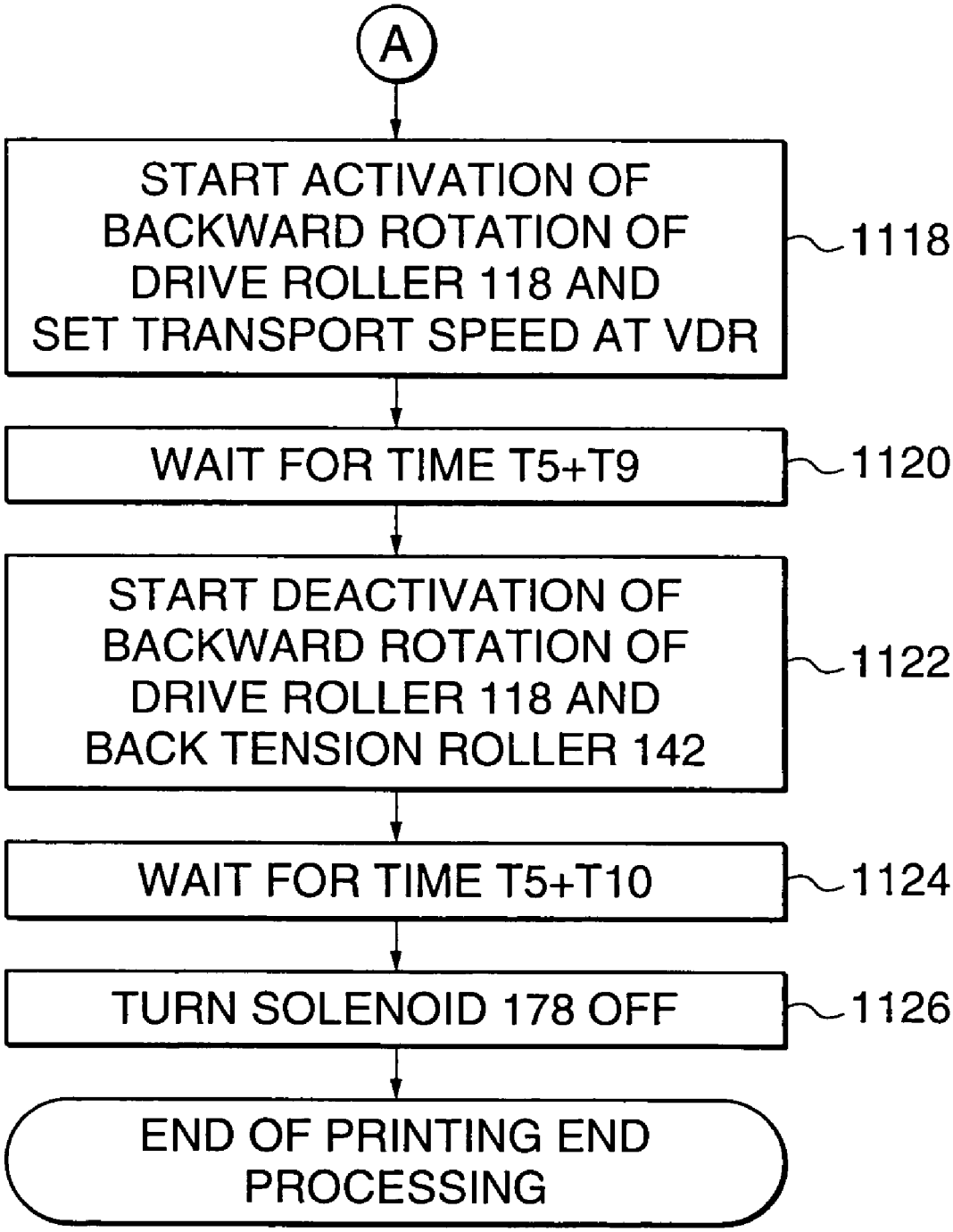

Hereinafter, referring to FIGS. 11 to 13, the control method of the present invention will be described along with the operation of the printer 1. FIG. 11 is a timing chart used for a control method performed by the control system 300. FIG. 12 is a flowchart of printing start processing performed by the control system 300. FIG. 13 is a flowchart of printing end processing performed by the control system 300.

Printing start processing is described with reference to FIGS. 11 and 12. The control part 310 starts printing start processing upon receiving a print command from the host device H such as PC through the communication part 360 or a print command inputted from the operation panel 380 by the user.

For the image forming part 200, the control part 310 rotates the photosensitive drum 210 and evenly electrifies the photosensitive drum 210 with negative charges (e.g., about −700V) by an electrostatic charger not shown. Then, the control part 310 drives the optical unit 220 (e.g., LED head) to irradiate the photosensitive drum 210 with light beams. In FIG. 11, an irradiation period of the optical unit 220 is WD. As a result, the even irradiation onto the photosensitive drum 210 forms a latent image of a portion corresponding to an image exposed by laser beams. Writing to the photosensitive drum 210 is started time T11 before the activation of the drive roller 118 described later. The time T11 is time necessary for the photosensitive drum 210 to move from a write position by the optical unit 220 to a transfer position by the transfer electrostatic charger 240. The time T11 and the like are stored in the memory 302.

Thereafter, the latent image is developed by a developing unit not shown. As a result, the latent image on the photosensitive drum 210 is visualized as a toner image.

For the transporting mechanism 100, the control part 310 controls the driver 330 to rotate a motor (not shown) for driving the scuff roller 122 to start the rotation of the scuff roller 122, and sets the transport speed of the scuff roller 122 at VS (step 1002). The transport speed VS (or a value corresponding to it (current value and voltage value)) and the like are stored in the memory 302 as described above.

Upon detecting using the oscillator 390 that time T8 has elapsed after the activation of the scuff roller 122 (step 1004), the control part 310 controls the driver 320 to rotate a motor (not shown) for driving the drive roller 118 to start the driving of the drive roller 118, and sets the transport speed of the drive roller 118 at VD (step 1006). The T8, which is time necessary for the activation of the forward rotation of the scuff roller 122, is controlled by the control part 310.

Upon detecting using the oscillator 390 that time T1 has elapsed after the activation of the scuff roller 122 (step 1008), the control part 310 controls the driver 340 to rotate a motor (not shown) for driving the back tension roller 142 to start the driving of the back tension roller 142, and sets the transport speed of the back tension roller 142 at VB (step 1010). The relation of VS>VD>VB exists among the transport speeds VS, VD, and VB.

The control part 310 waits for time T2 (step 1012), terminates the printing start processing, and proceeds to a printing operation. The time T2 is activation time for the forward rotation of the back tension roller 142, and T3, the sum of the times T1 and T2, is activation time for the forward rotation of the drive roller 118. The times T2 and T3 are controlled by the control part 310.

Meanwhile, the non-perforated continuous paper P is fed from the hopper 10, is bent by the round bar guides 112 and 114, and is transported to the back tension roller part 140 and the pre-centering mechanism 160. The pre-centering mechanism 160 presses and abuts the paper P against the guide edge 162 by the skew rollers 170*a* and 170*b* having a skew angle with respect to the transport direction F. Since the solenoid 178 is off, the skew rollers 170*a* and 170*b* are maintained in a position indicated by the dotted line in FIG. 7.

Thereafter, the continuous paper P reaches the drive roller 118 via the wraparound roller 116. The wraparound roller 116 has a sufficient wraparound angle for the drive roller 118. The drive roller 118 nips and transports the continuous paper P to the transfer position TR of the image forming part 200 by a frictional force along the transport direction F. The continuous paper P runs stably between the drive roller 118 and the back tension roller 142 because the tension of the continuous paper P is increased and its skew is reduced.

Figure 14:
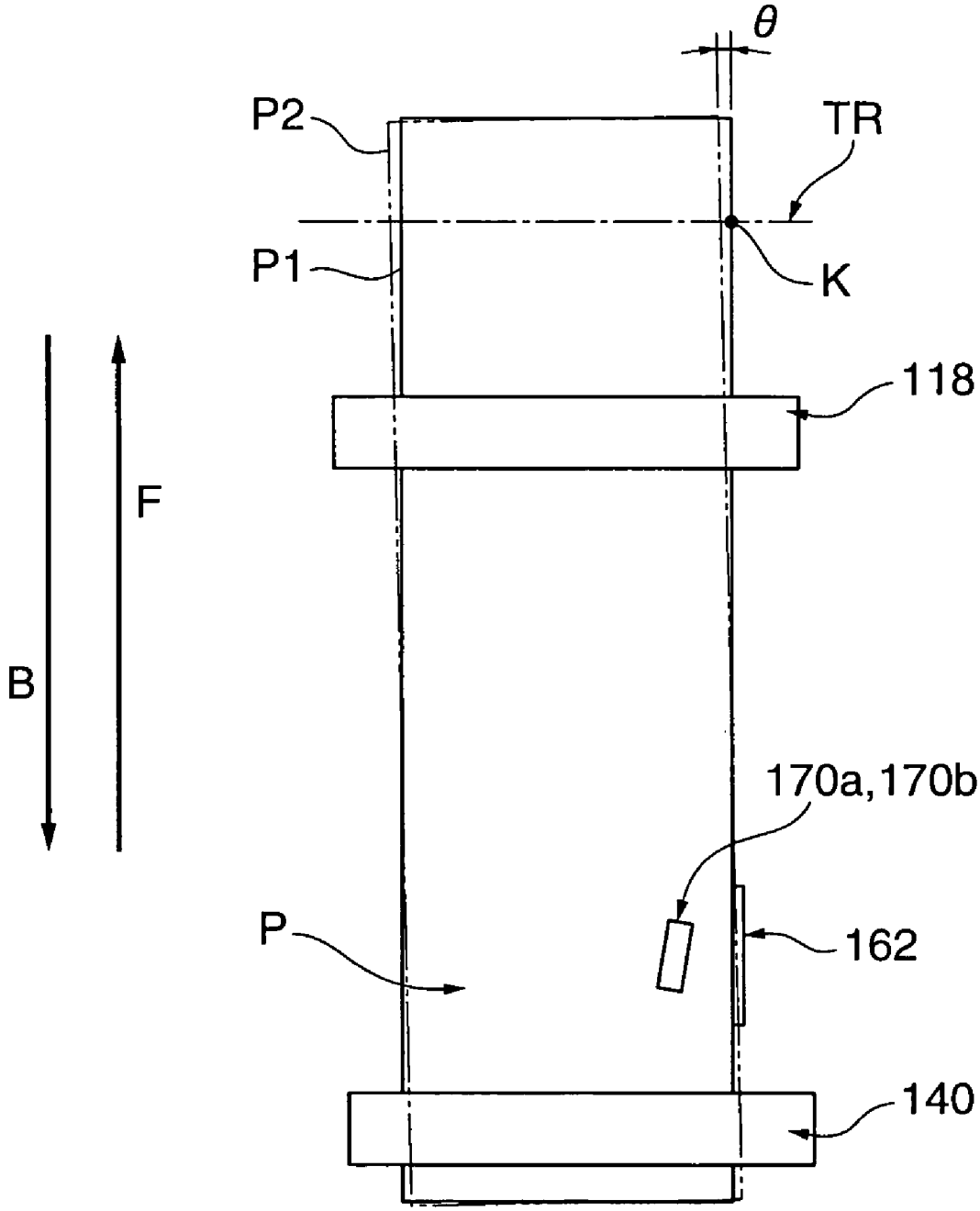
FIG. 14 is a plan view for explaining the operation of correcting a skew of continuous paper by the drive roller.
Figure 15:
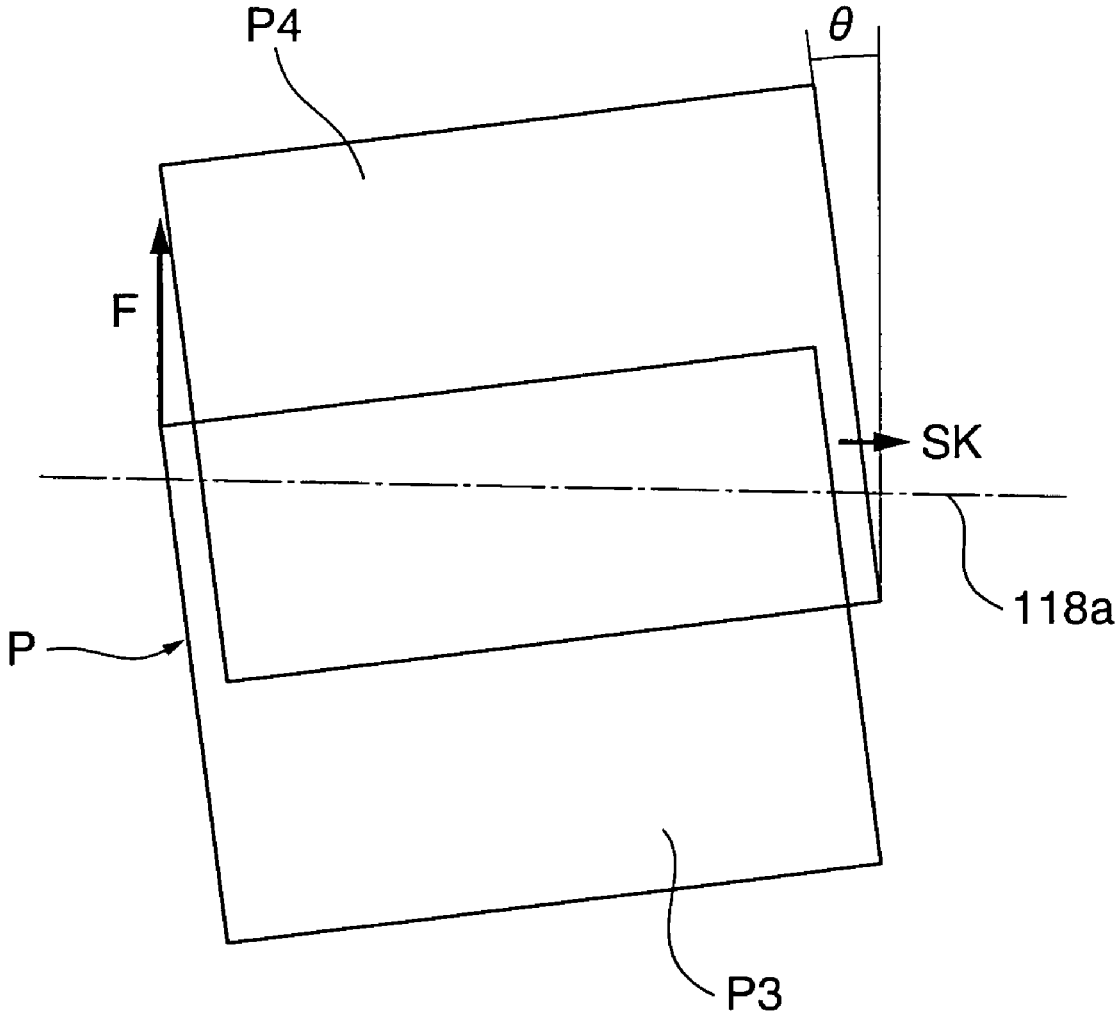
FIG. 15 is an enlarged plan view showing the neighborhood of the drive roller shown in FIG. 14.

Hereinafter, referring to FIGS. 14 and 15, a description will be made of how the drive roller 118 autonomously corrects a skew in the continuous paper P if any. FIG. 14 is a plan view for explaining the operation of correcting a skew of the continuous paper P by the drive roller 118. FIG. 15 is an enlarged plan view showing the neighborhood of the drive roller 118 in FIG. 14. In FIG. 14, the solid line P1 indicates the continuous paper P not skewed and the dotted line P2 indicates the continuous paper P skewed due to disturbance. The center of the dot indicated by K in the transfer position TR indicates an ideal position of an edge of the paper P. In FIG. 15, P3 indicates the position of the paper P before transport, and P4 indicates the position of the paper P after it is transported by transport force in the transport direction F by the drive roller 110. SK indicates the movement of the continuous paper P in a skew direction.

In the case where a skew occurs in the continuous paper P due to some disturbance, the disturbance causes the continuous paper P to rotate by a minute angle, centering around the edge guide 162 because of the regulation of the edge guide 162 by the skew rollers 170*a* and 170*b* of the pre-centering mechanism 160. Assume the angle at that time is θ.

On the other hand, the drive roller 118 produces force to transport the continuous paper P in a direction orthogonal to its axis. As a result, if the continuous paper P is skewed by angle θ, the edge of the continuous paper P and the axis line of the drive roller 118 will not become orthogonal to each other, and the edge of the continuous paper P will move in the right direction of FIG. 15 as the continuous paper P is transported. The amount of the movement is represented by an expression below.

$$\text{skew speed of paper} = \text{paper transport speed} \times \tan\theta \qquad \text{Expression 1}$$

According to the expression 1, if θ is negative (that is, the paper P is skewed in the right direction shown in FIGS. 14 and 15), the skew speed of the paper P becomes negative (left direction), and if θ is positive (that is, the paper P is skewed in the right direction shown in FIGS. 14 and 15), a skew speed becomes positive (right direction). If θ is 0, no skew speed is generated. That is, if the paper P is skewed due to disturbance, a skew speed (or energized force) in the direction of correcting the skew is produced by the drive roller 118, and eventually the continuous paper P is stabilized in a state in which the axis line of the drive roller 118 and the edge of the paper P are orthogonal to each other. The autonomous correction function of the drive roller 118 stabilizes paper running.

If the skew in the drive roller 118 is corrected and the tension of the paper P between the pre-centering mechanism 160 and the transfer position TR is sufficiently obtained, the edge of the paper P in the transfer position TR stabilizes in the position where a line orthogonal to the drive roller 118 with the edge guide 162 as a starting point and a line orthogonal to the transport direction F via the transfer position TR cross each other. This is because the edge of the continuous paper P is held almost linear when the continuous paper P is applied with tension and is not slack.

For the above-described reason, the paper edge in the transfer position TR stabilizes in almost the same position, reducing errors of writing positions in the transfer position. Although, in FIG. 15, the paper P is transported in parallel from position P3 to position P4 with θ kept, actually θ becomes smaller according to motion SK in the skew direction of the paper if the edge is regulated by the edge guide 162 and the paper is not slack with tension maintained.

Figure 16:
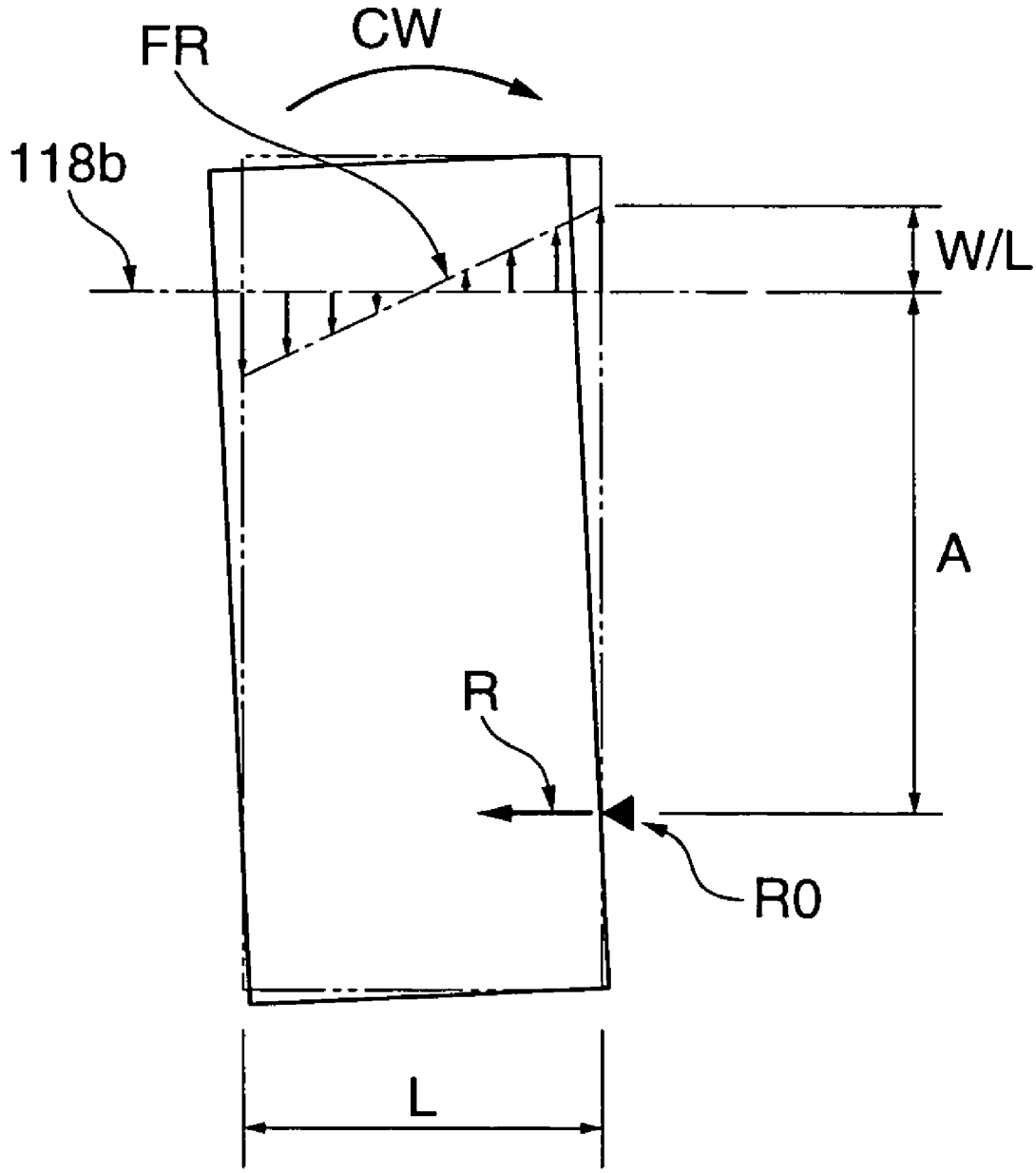
FIG. 16 is a plan view for explaining moment force generated in continuous paper.

Next, a description will be made of the behavior of the paper P upstream of the drive roller in the case where the paper P is sufficiently applied with tension and is not slack. As described above, in the case where the paper P is skewed by angle θ and the θ is brought near to 0 by the autonomous correction function of the drive roller 118, the paper P will rotate by a minute angle in the drive roller 118. As a result, the elements of paper speed in the transport direction differ slightly correspondingly to the rotation motion, depending on the width direction of the continuous paper P. On the other hand, since the circumferential speed of the drive roller 118 is constant in the width direction, a minute slip will occur between the paper P and the surface of the drive roller 118. A frictional load caused by the slip generates moment force on the paper P. This mechanical behavior is shown in FIG. 16. FIG. 16 is a plan view for explaining moment force generated in the paper P. In FIG. 16, 118*b* designates a line indicating the position where the drive roller 118 nips the paper P, and FR designates the range of frictional force produced by a slip of the drive roller. R0 designates a function point by the edge guide 162.

When the paper is positioned as shown by the solid line of FIG. 16, the paper P is to rotate in the rotation direction (clockwise) CW shown in the figure by the autonomous correction function of the drive roller 118. At this time, friction with the drive roller 118 exerts a frictional force on the paper P on the line 118*b* in the position where the drive roller 118 nips the paper P. The frictional force ranges in the width direction of the paper P as indicated by the range FR of FIG. 16. The frictional force becomes maximum at the both ends of the paper P and is represented by W/L (force per unit length). As shown in FIG. 16, L designates the width of the paper P and W designates the full transport force of the drive roller 118 when the paper P having a width of L is transported. The moment M of force applied to the paper P by the frictional force is represented as the product of the position of the paper P in the width direction and a frictional force in that position as shown by an expression below.

$$M = W \times L/6 \qquad \text{Expression 2}$$

Since the moment force must be offset by resilient force R in the function point R0 of the edge guide 162, when the distance between the drive roller 118 and the edge guide 162 is A as shown in FIG. 16, the following expression will hold.

$$R \times A = M = W \times L/6 \quad \text{Expression 3}$$

As a variant of the expression 3, expression 4 is obtained.

$$A/L = W/(6 \times R) \quad \text{Expression 4}$$

As a result of executing the expression 4, the value of R becomes L/(A×6) times W. W must be such a value as not to cause a large slip during normal transport, about 5 kgf or more per paper 15 inches in width. This is because a smaller value of W would cause the paper to be transported while slipping on the drive roller 118 all the time, resulting in unstable printing positions in the transport direction. On the other hand, R is preferably 0.8 kgf or less in order for the edge guide 162 to regulate the paper p without damaging it. This is because a larger value of R would cause an edge of the paper P to be damaged by the edge guide 162. If R=0.8 and W=5 are set in the above expression, $$A/L = 1.0 \quad \text{Expression 5}$$

holds, and the distance A must be 1.0 or more times the paper width L. If a larger value of W or a smaller value of R is desired, it is necessary to have a higher A/L ratio. In short, to stabilize paper skews by the autonomous correction function of the drive roller 118 requires that the distance A between the drive roller 118 and the edge guide 162 be larger than a value found by the above expression from a mechanical standpoint, preferably at least about 1.0 or more times the paper width.

Referring to FIG. 3, a description is made below of the reason why tension applied to the paper P would produce no slack. FIG. 3 is a plan view for explaining a case where the continuous paper P having slack in the left of it is transported by the drive roller 118 and the back tension roller 142. In FIG. 3, like FIG. 16, R0 designates a function point by the edge guide 162. Assume that the transport force of the drive roller 118 is set at W across the paper, N driven rollers 120 are abutted against the drive roller 118 at the back of the paper P, and a nip of the paper P by the rollers 118 and 120 applies transport force to the paper P. In this case, the transport force of one driven roller 120 is set at WIN.

Since a force applied to the paper P by the drive roller 118 is reaction to the transport load of the paper P, the smaller the transport load is, the smaller the transport force of the drive roller 118 is, and the larger the transport load is, the larger the transport force of the drive roller 118 is. Furthermore, if the load is larger than W, the drive roller 118 will cause a slip with the paper P. Accordingly, the specified transport force W is the largest value of endurable paper load, and a force actually applied to the paper changes depending on transport loads.

When slack S2 occurs at the left side of the paper P as shown in FIG. 3, hardly any load occurs in several driven rollers 120 at the left as shown by the arrows. This is because when the paper P moves to be transported by the drive roller 118, force against the transport is not exerted until the slack is absorbed and removed. Accordingly, a paper transport force, which is a resilient force of the paper load, becomes almost zero in this portion.

On the other hand, in the rightmost driven roller 120 of the figure, the largest transport force WIN occurs because there is no slack upstream of it. The transport force is a force for overcoming a paper load force U of the back tension roller part 140. If the relation of U<W/N or U=0 (the back tension roller part 140 is not provided) holds, the paper P can be transported without slip in the rightmost driven roller 120 attempting transport with the transport force W/N, and its transport speed becomes equal to the circumferential speed of the drive roller 118. Since the transport loads of the driven rollers 120 at other locations are small and have an identical transport speed, the slack of the paper P is not removed and the paper P is transported with the slack remaining.

On the other hand, if the relation of U>W/N is set, the rightmost driven roller 120 cannot overcome the paper load force U of the back tension roller part 140, so that the roller transports the paper P while slipping with the paper P. As a result, the transport speed of the paper P becomes slower than the circumferential speed of the drive roller 118.

On the other hand, since the driven rollers 120 at other locations transport the paper at the same speed as the circumferential speed of the drive roller 118, the paper P will rotate a little in the direction in which the slack of the paper P is removed. As a result, the slack will be removed as the paper P is transported. If the slack is removed, the transport forces of all the driven rollers 120 become U/N. At this time, to normally transport the paper P without slip requires the relation of U<W. If the relation of U>W exists, the paper will slip even if there is no slack, so that printing positions in the transport direction F will go out of alignment. In summary, it is desirable that U is within a range shown by an expression below.

$$W > U > W/N \quad \text{Expression 6}$$

If the load force U of the back tension roller part 140 is set as shown by the expression 6, even if a minute slack occurs in the paper P due to disturbance and the like, the slack can be removed by the interaction between the back tension roller part 140 and the drive roller 118, and the state in which the paper P is always free of slack can be formed. For example, U can be obtained by measuring current values of a motor actually driven, using the principle that there is a certain relationship between current values of a motor for driving the back tension roller 142 and the paper load force U. W can be measured by a spring balance, for example. U can be adjusted by the elastic force of the spring 145, the materials of roller (that is, a frictional force between the roller 142 and the paper P), a transport speed difference between the rollers 142 and 118, and a scuff transport force Y described later.

As is apparent from the foregoing, the slack removal effect of the back tension roller part 140 is effective only between the drive roller 118 and the back tension roller part 140. Since the slack of the paper P must not exist between the pre-centering mechanism 160 and the drive roller 118, the back tension roller part 140 must be provided upstream of the pre-centering mechanism 160. This is for the following reason. If the back tension roller part 140 is provided downstream of the pre-centering mechanism 160 in the transport direction F, since a slack occurring between the pre-centering mechanism 160 and the back tension roller part 140 is not removed, paper transport becomes unstable.

In the printing operation, referring back to FIG. 11, the control part 310 controls a transfer guide 242 not shown to bring the continuous paper P into intimate contact with the photosensitive drum 210. In FIG. 11, J1 designates the state in which the transfer guide 242 separates the paper P from the drum 210, and J2 designates the state in which the transfer guide 242 brings the continuous paper P into intimate contact with the drum 210.

The control part 310 sets the transport speed of the drive roller 118 at VD during the period of the intimate contact. Thereby, toner images formed on the photosensitive drum 210 are transferred to the continuous paper P transported in front of the transfer electrostatic charger 240. Specifically, the toner images on the surface of the photosensitive drum 210 are attracted and adhered to the print paper P, so that the toner images are transferred to the paper P. In other words, the paper P is printed during the period in which the transport speed of the drive roller 118 is VD.

Residual toners on the photosensitive drum 210 are cleaned by a cleaning part not shown in the figure. Then, the continuous paper P is fed to the flash fixing unit 270 by the transporting mechanism 100. The toners on the continuous paper P are permanently fixed by passing through the flash fixing unit 270.

Thereafter, the continuous paper P is ejected to the stacker 20 by the scuff roller 122. The control part 310 sets the transport speed of the started-up scuff rollers 122 at VS. The scuff rollers 122 are set to have a circumferential speed slightly higher than that of the drive roller 118 (accordingly VS>VD). The transport force Y of the scuff rollers 122 is set smaller than the transport force W of the drive roller 118, and the circumferential speed of the scuff rollers 122 is set higher than that of the drive roller 118. This generates tension in the continuous paper P after the drive roller 118. The continuous paper P is housed in the stacker 20 in a desired form such as the continuous paper P folded by a folding mechanism not shown.

Figure 17:
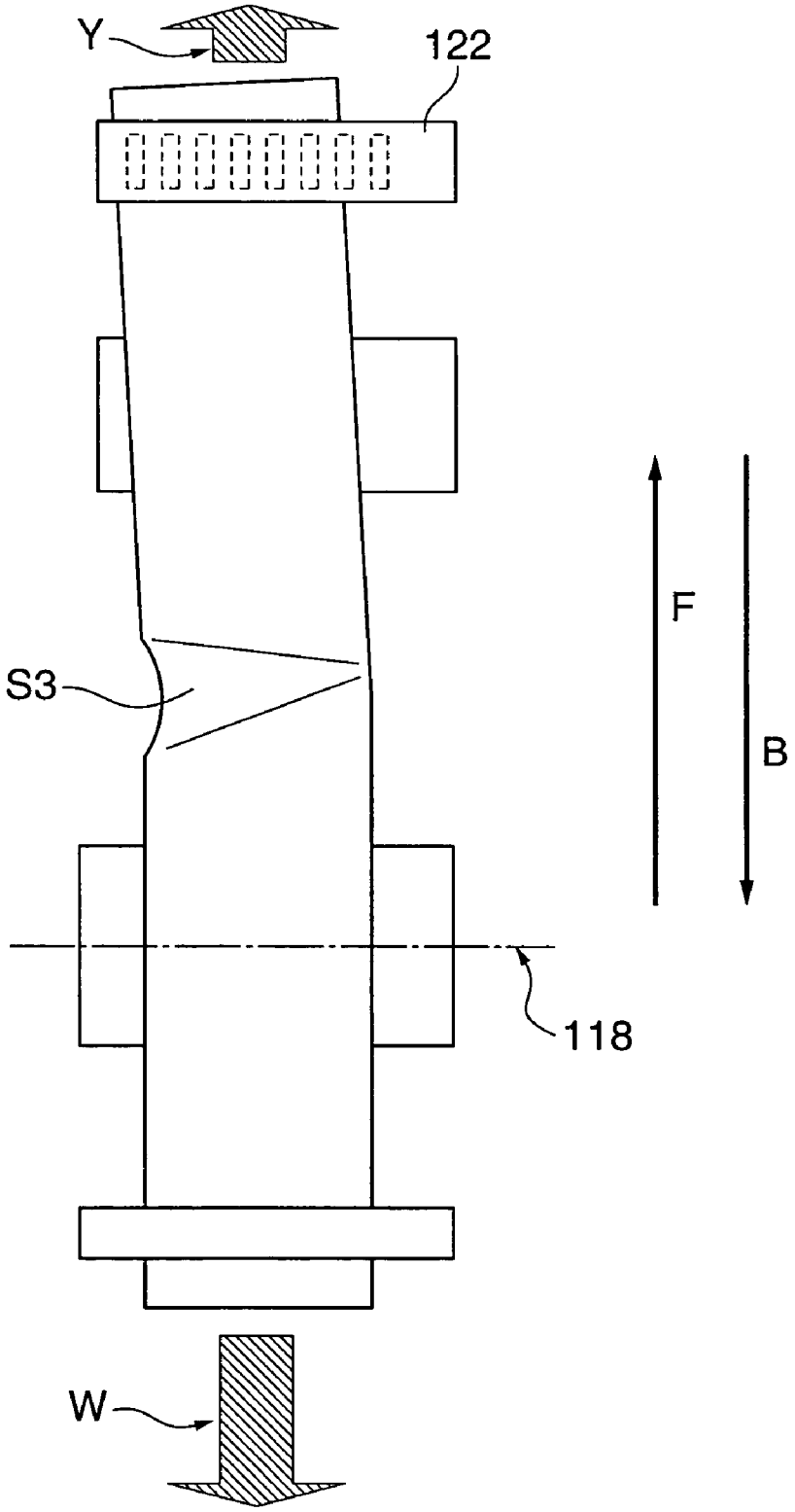
FIG. 17 is a plan view showing the state in which continuous paper having slack at the left side thereof is transported downstream of the drive roller.

Referring to FIG. 17, a description will be made of the behavior of the paper P downstream of the drive roller 118 with respect to the forward direction F. If the paper P is slack downstream of the drive roller 118, not only are printing positions in the paper width direction unstable but also transfer fails due to a poor contact of the paper P with the photosensitive drum 210, and unfixed toner images collapse because the transferred paper P rubs against a front end portion of the fixing unit 270 before it is fixed. FIG. 17 is a plan view showing a transport path downstream of the drive roller 118.

If the paper P is transported without slack, since the circumferential speed VS of the scuff rollers 122 is set higher than the circumferential speed VD of the drive roller 118, the scuff rollers 122 attempt to pull the paper P out of the drive roller 118. However, since the transport force Y of the scuff rollers 122 is smaller than the transport force W of the drive roller 118, a slip occurs between the scuff rollers 122 and the paper P, and the paper P is normally transported without slip in the drive roller 118. Although W is shown in an upward direction in FIG. 3, when force balance downstream of the drive roller 118 with respect to the forward direction (transport direction) F is considered, since the drive roller 118 acts as a brake against the transport force Y of the scuff rollers 122, W is shown by a downward arrow in FIG. 17.

When slack S3 occurs at the left side of the paper P as shown in FIG. 17, since a load against the transport force Y of the scuff rollers 122 does not function at the left side of the paper P in which the slack S3 occurs, the paper P is transported at the speed of the scuff rollers 122 faster than the circumferential speed of the drive roller 118. On the other hand, a transport load W of the drive roller 118 functions at the right side of the paper P where no slack occurs, and the paper P is transported at a normal circumferential speed of the drive roller 118. In this way, transport speeds differ in the width direction of the paper P, rotation force occurs in the paper P in the direction that absorbs the slack, and the slack is removed as the paper is transported. Thus, also in the downstream side of the drive roller 118 with respect to the transport direction F, since a minute slack in the paper P, if any, is immediately removed by the interaction between the drive roller 118 and the scuff rollers 122, the state in which the paper P is always free of slack can be formed.

If print data is exhausted, the printer 1 terminates the printing operation. If print data remains, the control part 310 performs a back feed operation described later. In the back feed operation, the drive roller 118 and the back feed operation 142 feed the continuous paper P back to the direction B. If the paper is immediately stopped at the termination of printing and transport driving is immediately started at the start of printing, the back feed operation is not required when printing is stopped. As described above, however, since printers have been sped up, an overrun occurs when paper is stopped, and a preparatory run is required when the transport of paper is started. For this reason, after the termination of printing, the continuous paper P is fed back in the backward direction B so that the interval between an image printed previously and the next image to be printed falls within a designated range.

During the back feed operation, the scuff rollers 122 stop. To perform printing termination processing, upon the termination of a printing operation, the control part 310 instructs the transfer guide 242 to separate the continuous paper P from the photosensitive drum 210. Printing termination processing is described below with reference to FIG. 13.

The control part 310, at the termination of the intimate contact of the continuous paper P with the photosensitive drum 210 by the transfer guide 242, starts deactivation operations on the drive roller 118 and the back tension roller 142 and controls the drivers 320 and 340 so that their transport speeds become zero (step 1102). The deactivation time of (the forward rotation of) the drive roller 118 is set at time T3, and the deactivation time of (the forward rotation of) the back tension roller 142 is set at time T2. Since the relation of T3−T2=T1>0 holds as described above, the back tension roller 142 has a transport speed of 0 earlier than the drive roller 118. The termination of the intimate contact of the continuous paper P with the photosensitive drum 210 by the transfer guide 242 occurs when time T11 has elapsed after the termination of writing to the photosensitive drum 210 by the optical unit 220.

The control part 310 detects using the oscillator 390 that time T3 has elapsed after the deactivation of the drive roller 118 and the scuff rollers 122 was started (step 1104). Then, the control part 310 starts a deactivation operation on the scuff rollers 122 and controls the driver 330 so that their transport speed becomes zero (step 1106). The deactivation time of the scuff rollers 122 is set at time T8. Thus, the scuff rollers 122 are driven earlier than the drive roller 118, and continue to rotate for a designated time even after the drive roller 118 terminates printing.

The control part 310 detects using the oscillator 390 that time T7 has elapsed after the deactivation of the scuff rollers 122 was started (or after the drive roller 118 stopped printing) (step 1108). Then, the control part 310 controls the driver 350 so that the solenoid 178 goes on (step 1110). The solenoid 178 undergoes displacement against an energized force of the spring 179, with the result that the skew rollers 170*a* and 170*b* move from the position indicated by the dotted line shown in FIG. 7 to the position indicated by the solid line. The relation of T7<T8 exists between time T7 and time T8.

The control part 310 detects using the oscillator 390 that time (T8-T7-T4) has elapsed after the deactivation of the drive roller 118 and the solenoid 178 was turned on (step 1112). Then, the control part 310 starts the activation of the backward rotation of the back tension roller 142 and controls the driver 340 so that and its transport speed becomes VBR (step 1114). The activation of the backward rotation of the back tension roller 142 is started time (T3+T7) after the deactivation of the forward rotation of the back tension roller 142 is started, and its transport speed is zero for a period of T1+T7. Activation time at the backward rotation of the back tension roller 142 is set at T6.

The control part 310 detects using the oscillator 390 that time T4 has elapsed after the activation of the backward rotation of the back tension roller 142 was started (step 1116). Then, the control part 310 starts the activation of the backward rotation of the drive roller 118 and controls the driver 320 so that its transport speed becomes VDR (step 1118). The relation of VBR>VDR holds between the transport speeds VDR and VBR. Activation time at the backward rotation of the drive roller 118 is set at time T5.

The control part 310 controls the drivers 320 and 340 so that the back feed operations on the continuation paper P by the drive roller 118 and the back tension roller 142 occur for time T9 at the same time. The transport speed of the scuff rollers 122 remains zero during the back feed transport period T9. The skew rollers 170*a* and 170*b* abut the continuous paper P against the edge guide 162 in the position indicated by the solid line shown in FIG. 7 to prevent it from swinging. A back feed operation pulls the paper P back to form slack S1 in the vicinity of the round bar guides 112 and 114 as shown by the dotted line in FIG. 1.

The control part 310 detects using the oscillator 390 that time T5+T9 has elapsed after the activation of the backward rotation of the drive roller 118 was started (step 1120). Then, the control part 310 starts the deactivation of the backward rotation of the drive roller 118 and the back tension roller 142 and controls the drivers 320 and 340 so that their transport speeds become zero (step 1122). Deactivation time at the backward rotation of the drive roller 118 is set at time T5, and deactivation time at the backward rotation of the back tension roller 142 is set at time T6. The relation of T6−T5=T4 exists among times T4 to T6.

In this way, the back tension roller 142 is, during printing, rotationally driven in the forward direction at the speed VB slower than the speed VD of the driver roller 118. The back tension roller 142 is driven later than the drive roller 118, and deactivated earlier than the drive roller 118. Even at the start and termination of the driving of the back tension roller 142, tension on the continuous paper P is secured. On the other hand, during back feed, the back tension roller 142 is backward driven at the speed VBR faster than the speed VDR of the drive roller 118. In this case, the back tension roller 142 is driven earlier than the drive roller 118, and deactivated later than the drive roller 118. Also in this case, tension on the continuous paper P is secured.

The control part 310 detects using the oscillator 390 that time T5+T10 has elapsed after the activation of the backward rotation of the drive roller 118 and the back tension roller 142 was started (step 1124). Then, the control part 310 controls the driver 350 so that the solenoid 178 goes off (step 1126). The time T10 is set as a period after the backward rotation of the drive roller 118 terminates and the drive roller 118 is stopped until the solenoid 178 goes off. As a result, the solenoid 178 is returned to its original position by the spring 179, and the skew rollers 170*a* and 170*b* return from the position indicated by the solid line of FIG. 7 to the position indicated by the dotted line. Thereby, the skew rollers 170*a* and 170*b* can provide for transport in the direction F in a following printing operation. In this way, the solenoid 178 is controlled so that it is off during normal printing and goes on during back feed.

As a result, the printing termination processing is terminated. By the printing termination processing, the continuous paper P is fed back by a designated distance and positioned so that the next printing start position follows at a designated distance from a previous printing termination position.

With the above-described construction, the back tension roller part 140 increases tension on the paper P to prevent slack in it when the paper P is transported in both the forward direction F and the backward direction B. Therefore, a lower cost and a smaller size of the apparatus can be achieved than if a different tension increasing unit is provided for each of the both transport directions. Also, since the back tension roller part 140 removes slack by rotation, the apparatus can be made more compact than conventional accumulators removing slack by vertical movement, and stable paper running can be achieved because of freedom from vertical movement in the transport directions. The back tension roller part 140 has higher resistance to wear than vacuum brakes and can produce stable tension increasing effects for paper sheets having different paper widths as well. Moreover, since the back tension roller part 140 is provided upstream of the pre-centering mechanism 160, an increase in paper slack can be prevented in a wide range.

Figure 18:
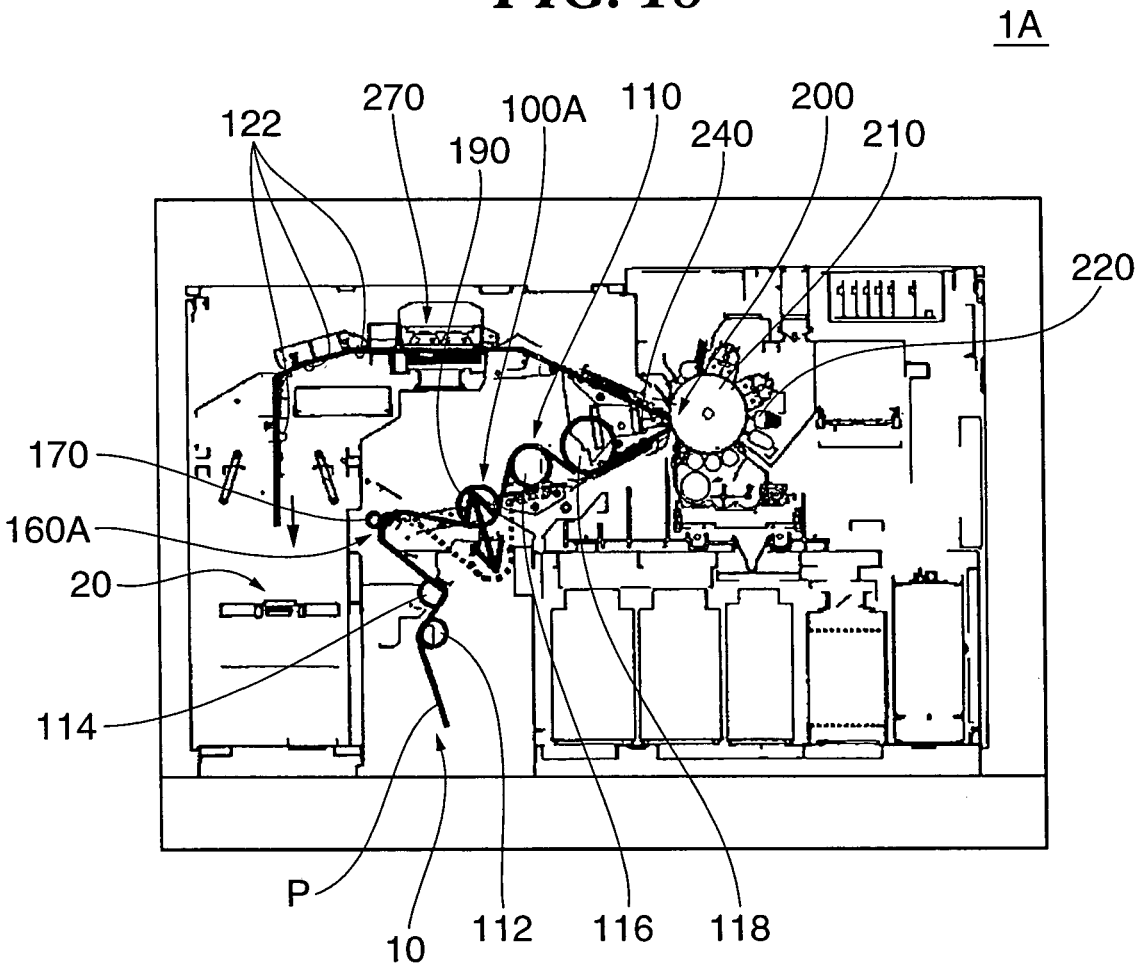
FIG. 18 is a sectional view of a printer of a second embodiment of the present invention.

Hereinafter, a printer 1A of a second embodiment of the present invention will be described with reference to FIG. 18. FIG. 18 is a sectional view of the printer 1A. As shown in the figure, the printer 1A includes: a hopper 10 that stores continuous paper P; a stacker 20 that stores continuous paper P on which designated images are formed; a transporting mechanism 100A; an image forming part 200; and a control system 300A (not shown in FIG. 1). Members shown in FIG. 18 that are identical to members shown in FIG. 1 are identified by the same reference numbers, and will not be described duplicately.

Figure 19:
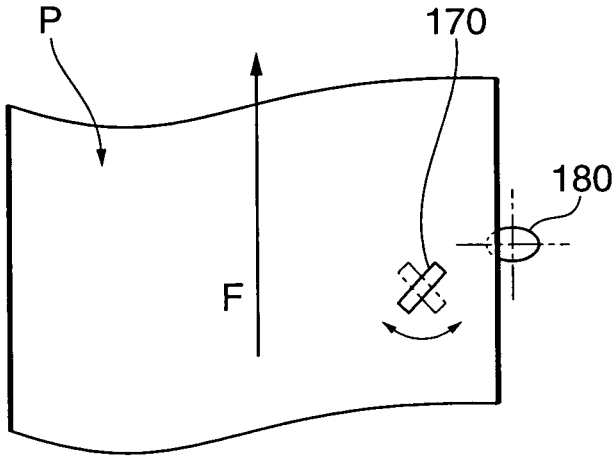
FIG. 19 is a schematic plan view of a pre-centering mechanism of the printer shown in FIG. 18.

The transporting mechanism 100A includes a transporting system 110, a pre-centering mechanism 160A, and a back tension roller part 190. The pre-centering mechanism 160A has a function for adjusting or bringing within a permissible range the position of the continuous paper P in a direction orthogonal to the transport direction F of the paper P, and a skew roller 170 and a detection unit 180 as shown in FIG. 19. Also, the pre-centering mechanism 160A further includes the same paper guide 161 (omitted in FIG. 19) as shown in FIG. 8. FIG. 19 is a plan view of the pre-centering mechanism 160.

Thus, the pre-centering mechanism 160A of this embodiment does not include the edge guide 162 as shown in FIG. 8. If the skew roller part 170 is used to press the paper P against the edge guide 162, in the case where the paper P is flexible thin paper, an edge of the paper P may be crushed when it is pressed against the edge guide 162. For this reason, the pre-centering mechanism 160A positions the paper P by letting the paper P eliminate swing in a direction orthogonal to the transport direction F without pressing an edge of the paper P against the edge guide. Thus, the pre-centering mechanism 160A of this embodiment is particularly suitable for flexible paper such as thin paper.

The pre-centering mechanism 160A is different from the pre-centering mechanism 160 in that it has a detection unit 180. The detection unit 180 is part of the sensor 370 shown in FIG. 10. The detection unit 180, which detects the position of the edges of the paper P, includes a translucent or reflective optical sensor. Detection results by the detection unit 180 are sent to the control part 310, which controls the driver 330 as described later, based on the detection results.

The buffer roller part 190, when the drive roller 118 feeds back the continuous paper P, applies tension to the paper P to remove slack from the paper P. The buffer roller part 190 is made up of a conventional accumulator swinging vertically, as described in the above-described patent publication. Thus, in this embodiment, the buffer roller part 190 is used instead of the back tension roller part 140. The manner in which the buffer roller part 190 moves vertically is shown by the dotted lines and the arrow in FIG. 18.

Figure 20:
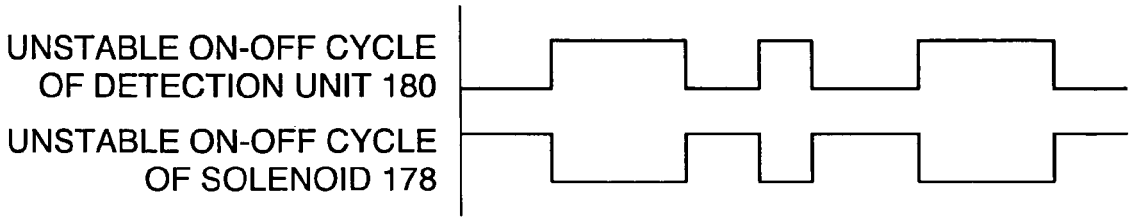
FIG. 20 is a timing chart showing the relationship between detection results of a detection unit and a drive signal to a solenoid.
Figure 21:
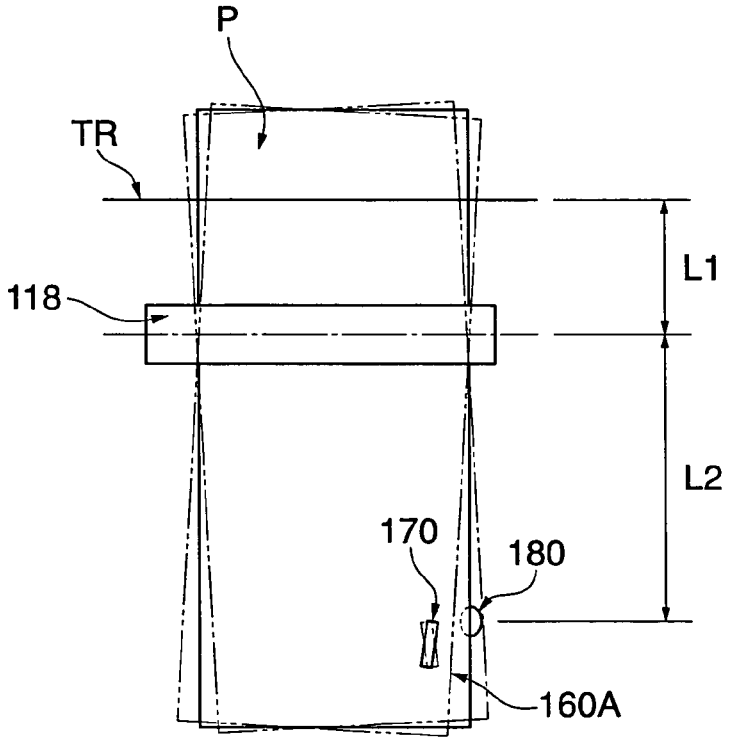
FIG. 21 is a plan view for explaining the behavior of continuous paper as results of control by a control part.

The control system 300A (not shown in FIG. 18) is the same as the control system 300 shown in FIG. 10, except that the driver 340 does not exist. Control of the driver 350 by the control part 300A is different from that in the first embodiment, in that a skew angle of the skew roller part 170 is changed while the paper P is transported in the transport direction F. Hereinafter, control of the driver 350 (and the skew roller part 170) by the control part 310 will be described with reference to FIGS. 20 and 21. FIG. 20 is a timing chart showing the relationship between detection results of the detection unit 180 and a drive signal to the solenoid 178. FIG. 21 is a plan view for explaining the behavior of continuous paper as results of control by the control part 310.

The detection unit 180 is made up of a translucent sensor having a light emitting element and a light receiving element. Assume the case where it is disposed vertically at the position (the cross position of FIG. 19 ideal to the right end of the paper P) through which the right end of the paper P shown in FIG. 19 is transported without skew. A detection result of the detection unit 180 when the right edge of the paper P is at the ideal position may be on (or high) or off (or low). In FIG. 19, if the right end of the paper P is at the right of the ideal position, the detection unit 180 detects the right end of the paper P and a detection result goes on. If the right end of the paper P is at the left of the ideal position, since the detection unit 180 does not detect the right end of the paper P, a detection result goes off. It is understood from FIG. 20 that the detection unit 180 does not go on or off at a constant cycle and the paper P fluctuations in the width direction.

The skew rollers 170*a* and 170*b*, when the solenoid 178 is on, skew the paper P rightward (toward the detection unit 180), and when the solenoid 178 is off, skew the paper P leftward (in a direction that moves away from the detection unit 180). The skew angles are about ±2 degrees.

The control part 310, based on the detection result of the detection unit 180, controls the driver 350 for driving the solenoid 178 so that the right edge of the paper P comes over the detection unit 180, and adjusts skew angles within a range from $-\theta_0$ to $+\theta_0$. Such control causes the right edge of the paper P to swing a little over the detection unit 180. That is, the swing or vibration of the paper P can be reduced but cannot be zeroed.

A study is made of a fluctuation amount (represented by ET) of an edge of the paper P in the transfer position TR when the paper edge swings in the vicinity of the detection unit 180. As shown in FIG. 21, since the paper P is nipped by the drive roller 118 and the driven rollers 120, the paper P moves little in the paper width direction and rotates by a minute angle, centering around the drive roller part. In other words, if a fluctuation amount (represented by ES) in the width direction of the paper P in the vicinity of the detection unit 180 is larger, the fluctuation amount ET also becomes larger, and therefore transfer capability worsens and printing quality reduces.

Figure 22:
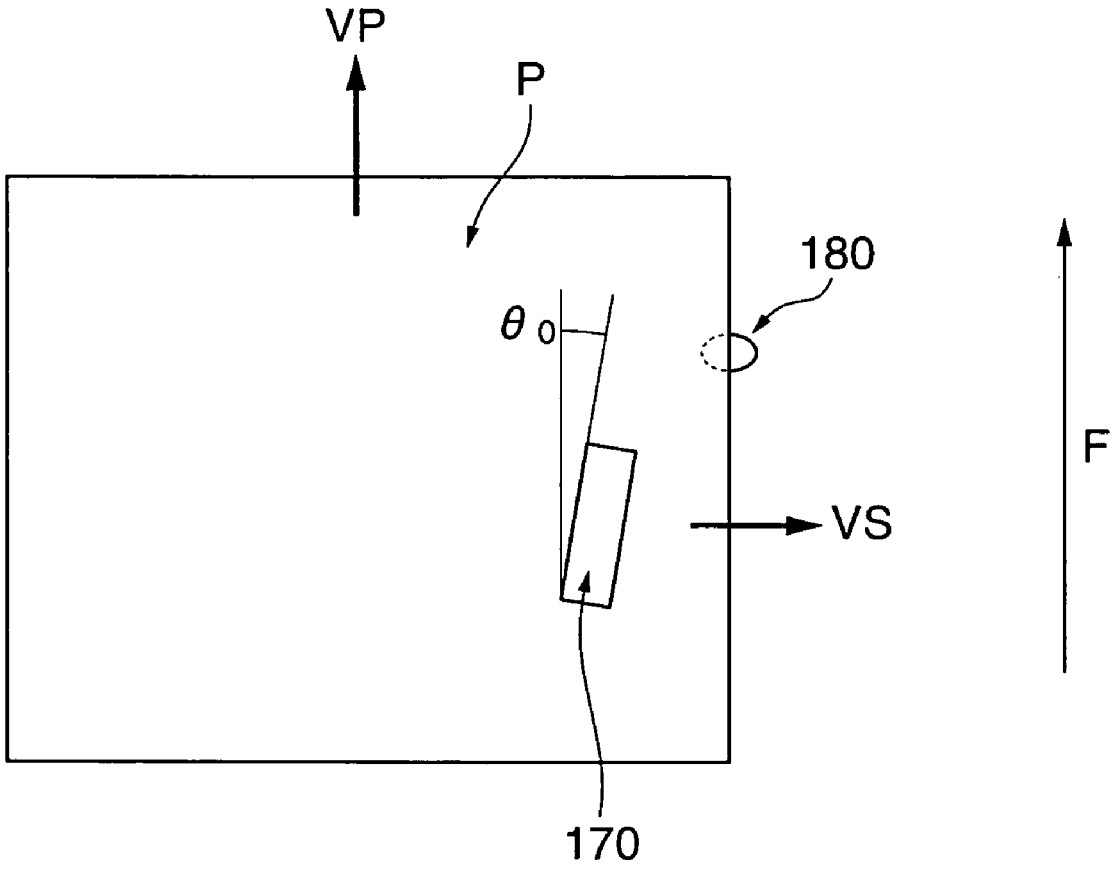
FIG. 22 is a plan view showing the neighborhood of a detection unit for explaining a skew correction method.

One idea for preventing such a problem is to reduce ES. A method of correcting ES to reduce it is described with reference to FIG. 22. FIG. 22 is a plan view showing the neighborhood of the detection unit 180 for explaining a method of correcting ES to reduce it. To approximately calculate the fluctuation amount ES, if θ is sufficiently small, when a paper transport speed is VP, a skew speed VS by the correction can be represented by an expression below.

$$VS=VP\times\theta\times\pi/180 \qquad \text{Expression 7}$$

θ (degree) is an actual swing angle of the skew rollers 170*a* and 170*b* and is a value satisfying the expression below.

$$-\theta_0\leqq\theta\leqq\theta_0 \qquad \text{Expression 8}$$

θ can be approximately estimated by an expression below.

$$\theta=\theta_0\times\mathrm{Sin}(\pi/T\times t) \qquad \text{Expression 9}$$

T is time required when the skew rollers 170*a* and 170*b* moves from $-\theta_0$ to $\theta_0$.

From these values, a fluctuation amount ES of the paper P in the detection unit 180 is estimated from a VS time integral value by an expression below.

$$ES=VP\times\theta_0\times T\times 2/180 \qquad \text{Expression 10}$$

Figure 23:
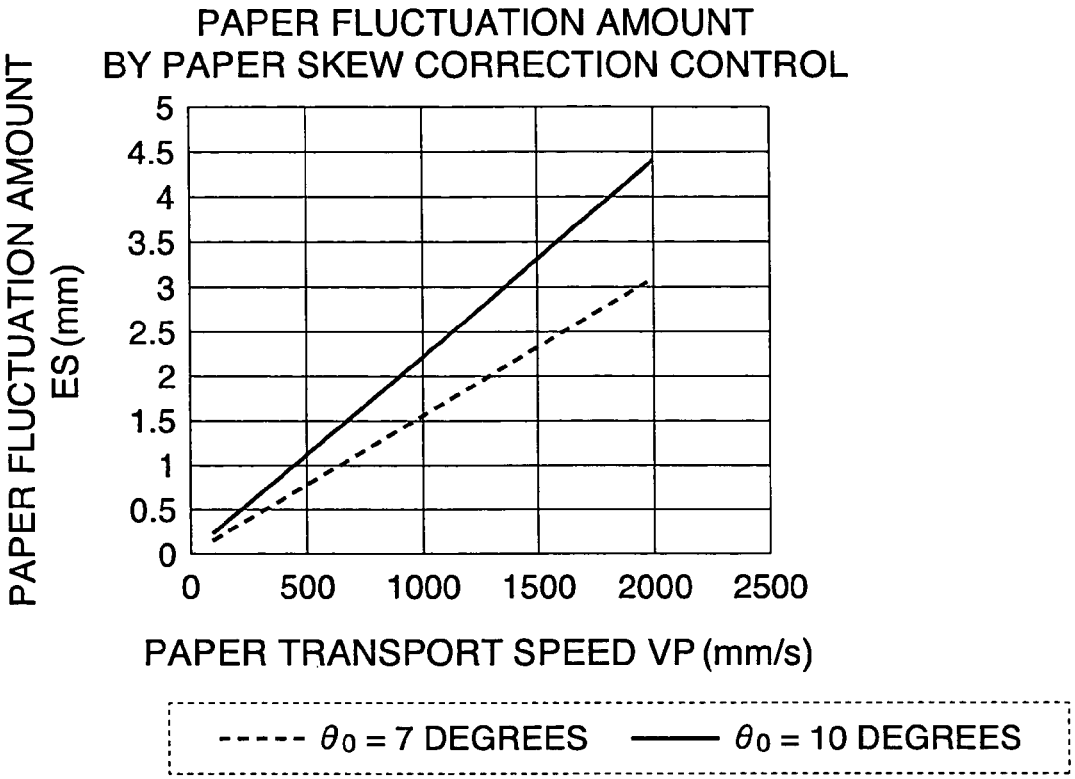
FIG. 23 is a graph showing the relationship between paper edge fluctuation amounts and paper transport speeds in the neighborhood of the detection unit shown in FIG. 22.

ES is represented by a graph as shown in FIG. 23. The horizontal axis indicates the paper transport speed VP, the vertical axis indicates the fluctuation amount ES of the paper P in the detection unit 180, and 20 ms is assigned to T for calculation. It is understood from the graph and the expression 10 that an increase in the paper transport speed VP because of recent demands for high-speed transport (and high-speed printing) would entail an increase in the paper fluctuation amount ES in the detection unit 180. One idea for reducing ES is to reduce $\theta_0$. This is because the graph produced based on the values of $\theta_0$ of 7 and 10 degrees shows that the smaller $\theta_0$ value of 7 degrees yields a smaller ES value and the expression 10 indicates that smaller $\theta_0$ values yield smaller ES values. Also, although not shown in the graph, it is understood from the expression 10 that smaller T values yield smaller ES values.

However, there is a limitation in the speedup of the paper transport speed VP to meet market demands for high speed transport of printers and therefore a reduction in $\theta_0$ and/or T. The reasons for it are that (1) a reduction in $\theta_0$ requires severe mounting precision of the skew roller part 170 and invites higher costs, and (2) a reduction in T requires quick response of the solenoid 178 and other driving units, and increases the sizes and costs of the solenoid 178 and other components. Accordingly, a method of reducing ES only by reducing $\theta_0$ and T is not advisable under demands for the speedup of the paper transport speed VP and cannot often be achieved in terms of costs.

Accordingly, as a result of examining FIG. 21 again, the present invention focused attention on the fact that the fluctuation amount ET of a paper edge in the transfer position TR is determined from the fluctuation amount ES in the detection unit 180, the distance L1 between the drive roller 118 and the transfer position TR, and the distance L2 between the pre-centering mechanism 160A (detection unit 180) and the drive roller 118 by an expression below.

$$ET=ES\times L1/L2 \qquad \text{Expression 11}$$

$$ET/ES=L1/L2 \qquad \text{Expression 12}$$

The above-described expression shows that ET (fluctuation amount) is increased for larger values of L1/L2 and reduced for smaller ones. To eliminate variations in printing positions due to fluctuation of the paper P, it is desirable to reduce ET by minimizing L1/L2. At least to prevent an increase in fluctuation, L1/L2 must be equal to or smaller than 1.

Thus, the present invention reduces the fluctuation amount ET of the paper P in the transfer position TR regardless of the existence of ES, the fluctuation amount ET influencing actual printing position precision. In other words, the present invention intends to reduce the values of ET with respect to ES, that is, make η of an expression below positive.

$$\text{Reduction effect } \eta=(ES-ET)/ES \qquad \text{Expression 13}$$

Figure 24:
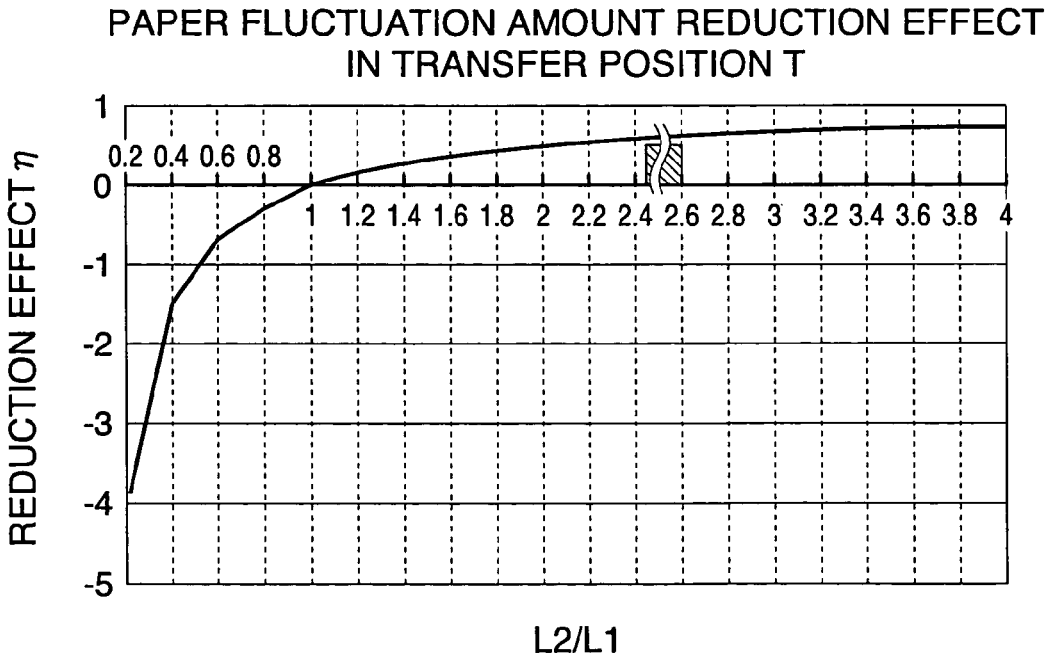
FIG. 24 is a graph for explaining the effects of reducing the amount of continuous paper fluctuation in transfer positions.

If η is positive and its absolute value is larger, the effect of reducing ET becomes greater. If η is negative, no reduction effect is produced and ET becomes larger than ES. The relationship between η and L2/L1 is shown in FIG. 24. The graph shows that making L2 larger would make η larger; that is, the fluctuation amount ET of the paper P in the transfer position TR is reduced. The hatched area in FIG. 24 is an area having an ET reduction effect obtained by the present invention. A reduction effect occurs in areas where L2/L1 is equal to or greater than 1 and η is positive. If L2/L1 is larger, a reduction effect becomes greater. However, if L2/L1 is equal to or less than 1, no reduction effect is produced because η becomes negative, and ET becomes larger than ES. A reduction effect occurs only in areas where L2/L1 is equal to or greater than 1. The present invention does not hinder reduction of ES together with reduction of L2/L1. Therefore, $\theta_0$ and/or T may be reduced together with reduction of L2/L1.

A paper transporting apparatus according to an aspect of the present invention contributes to a lower cost and a smaller size of the apparatus while maintaining running stability of paper. A paper transporting apparatus according to another aspect of the present invention regulates the position of paper in a direction orthogonal to a transport direction of the paper without pressing a paper edge. With this construction, the paper transporting apparatus can prevent the paper from being buckled and is suitable for transport of a variety of paper types. In addition, the paper transporting apparatus can reduce fluctuation amounts in transfer positions and prevent reduction in printing quality.

What is claimed is:

1. A paper transporting apparatus transporting continuous paper to a paper processing part that performs designated processing on the continuous paper, comprising:

a drive roller that transports the continuous paper in a forward direction with respect to the paper processing part and a direction opposite to the forward direction by a frictional force;

a pre-centering mechanism, disposed upstream of the drive roller with respect to the forward direction, that regulates a position of the continuous paper with respect to a direction orthogonal to the forward direction and the backward direction by abutting against the continuous paper; and a tension increasing mechanism, disposed upstream of the pre-centering mechanism with respect to the forward direction, that increases tension on the continuous paper, wherein the tension increasing mechanism includes a roller that rotates in the forward direction at a circumferential speed slower than a transport speed of the drive roller when the drive roller transports the continuous paper in the forward direction, and that rotates in the backward direction at a circumferential speed faster than the transport speed of the drive roller when the drive roller transports the continuous paper in the backward direction.

2. A paper transporting apparatus transporting continuous paper to a paper processing part that performs designated processing on the continuous paper, comprising:

a drive roller that transports the continuous paper in a forward direction with respect to the paper Processing part and a direction opposite to the forward direction by a frictional force;

a pre-centering mechanism, disposed upstream of the drive roller with respect to the forward direction, that regulates a position of the continuous paper with respect to a direction orthogonal to the forward direction and the backward direction by abutting against the continuous paper; and a tension increasing mechanism, disposed upstream of the pre-centering mechanism with respect to the forward direction, that increases tension on the continuous paper, wherein the pre-centering mechanism includes:

a guide part that abuts against an edge of the continuous paper to regulate its position; and a skew roller, provided at a designated angle with respect to the guide part, that energizes the continuous paper so as to press the continuous paper against the guide part when the continuous paper is transported in the forward direction and the backward direction, the designated angle being set variable.

3. A paper transport method comprising the steps of:

driving a drive roller that nips continuous paper together with plural driven rollers and transports the continuous paper to a paper processing part performing designated processing on the continuous paper by a frictional force in a forward direction and a direction opposite to the forward direction;

increasing tension on the continuous paper when the continuous paper is transported via a tension increasing mechanism provided upstream of a pre-centering mechanism with respect to the forward direction, wherein the pre-centering mechanism is disposed upstream of the drive roller with respect to the forward direction and regulates the position of the continuous paper with respect to a direction orthogonal to the forward direction and the backward direction by abutting against the continuous paper; and controlling one of the driving step and the increasing step so that a relation of W>U>W/N holds, where W is a transport force by the drive roller, N is the number of the driven rollers, and U is a paper load force by the tension increasing mechanism.

4. The paper transport method according to claim 3, wherein the control step controls the driving step and/or the increasing step so that A/L is 1.0 or more, where A is a distance between a portion of the pre-centering mechanism abutting against the continuous paper and the drive roller, and L is a width of the continuous paper.

5. The paper transport method according to claim 3, wherein the tension increasing mechanism includes a roller, and the increasing step rotates the roller of the tension increasing mechanism at a rotation speed slower than a rotation speed of the drive roller when the continuous paper is transported to the paper processing part.

6. The paper transport method according to claim 3, wherein the tension increasing mechanism includes a roller, and the increasing step rotates the roller of the tension increasing mechanism at a rotation speed faster than the rotation speed of the drive roller when the continuous paper is transported in a direction opposite to the paper processing part.

7. The paper transporting apparatus according to claim 1, wherein the pre-centering mechanism includes:

a guide part that abuts against an edge of the continuous paper to regulate its position; and a skew roller, provided at a designated angle with respect to the guide part, that energizes the continuous paper so as to press the continuous paper against the guide part when the continuous paper is transported in the forward direction and the backward direction, the designated angle being set variable.

8. A paper transport method comprising the steps of:

driving a drive roller that nips continuous paper together with plural driven rollers and transports the continuous paper to a paper processing part performing designated processing on the continuous paper by a frictional force in a forward direction and a direction opposite to the forward direction;

increasing tension on the continuous paper when the continuous paper is transported in the forward direction and the backward direction via a tension increasing mechanism provided upstream of a pre-centering mechanism with respect to the forward direction, wherein the pre-centering mechanism is disposed upstream of the drive roller with respect to the forward direction and regulates the position of the continuous paper with respect to a direction orthogonal to the forward direction and the backward direction by abutting against the continuous paper; and controlling one of the driving step and the increasing step so that a relation of $W>U>W/N$ holds, where W is a transport force by the drive roller, N is the number of the driven rollers, and U is a paper load force by the tension increasing mechanism.

9. An image forming apparatus comprising:

an image forming part that forms a designated image on continuous paper;

a drive roller that transports the continuous paper to the image forming part by a frictional force;

a pre-centering mechanism that is disposed upstream of the drive roller with respect to a transport direction and regulates a position of the continuous paper with respect to a direction orthogonal to the transport direction by abutting against an edge of the continuous paper extending lengthwise; and a tension increasing mechanism, disposed upstream of the pre-centering mechanism with respect to the transport direction, that increases tension on the continuous paper, wherein the drive roller transports the continuous paper in a forward direction with respect to the image forming part and a direction opposite to the forward direction, and wherein the tension increasing mechanism includes a roller that rotates in the forward direction at a circumferential speed slower than a transport speed of the drive roller when the drive roller transports the continuous paper in the forward direction, and that rotates in the backward direction at a circumferential speed faster than the transport speed of the drive roller when the drive roller transports the continuous paper in the backward direction.

10. An image forming apparatus comprising:

an image forming part that forms a designated image on continuous paper;

a drive roller that transports the continuous paper to the image forming part by a frictional force;

a pre-centering mechanism that is disposed upstream of the drive roller with respect to a transport direction and regulates a position of the continuous paper with respect to a direction orthogonal to the transport direction by abutting against an edge of the continuous paper extending lengthwise; and a tension increasing mechanism, disposed upstream of the pre-centering mechanism with respect to the transport direction, that increases tension on the continuous paper, wherein the drive roller transports the continuous paper in a forward direction with respect to the image forming part and a direction opposite to the forward direction, and wherein the pre-centering mechanism includes:

a guide part that abuts against an edge of the continuous paper to regulate its position; and a skew roller, provided at a designated angle with respect to the guide part, that energizes the continuous paper so as to press the continuous paper against the guide part when the continuous paper is transported in the forward direction and the backward direction, the designated angle being set variable.

* * * * *